US005195848A

United States Patent [19]

Huete et al.

[11] Patent Number: 5,195,848

[45] Date of Patent: Mar. 23, 1993

[54] METHOD AND SYSTEM FOR DEVELOPING OFFSHORE HYDROCARBON RESERVES

[75] Inventors: David A. Huete, Spring; Lee K. Brasted, Kingwood; George Rodenbusch, Houston, all of Tex.

[73] Assignee: Shell Oil Company, Houston, Tex.

[21] Appl. No.: 919,629

[22] Filed: Jul. 24, 1992

Related U.S. Application Data

[63] Continuation of Ser. No. 624,864, Dec. 10, 1990, abandoned.

[51] Int. Cl.[5] ..... E02B 17/00

[52] U.S. Cl. ..... 405/202; 175/7; 405/223.1; 405/224.2

[58] Field of Search ..... 405/195.1, 202, 203, 405/223.1, 224, 224.2; 114/264, 265; 166/350, 353, 359, 366, 367; 175/7

[56] References Cited

U.S. PATENT DOCUMENTS

| | | | |
|---|---|---|---|
| 3,504,740 | 4/1970 | Manning | 166/0.5 |
| 3,717,002 | 2/1973 | O'Brien et al. | 61/72.3 |
| 3,727,414 | 4/1973 | Davies . | |
| 4,156,577 | 5/1979 | McMakin | 405/196 |
| 4,492,270 | 1/1985 | Horton | 166/358 |
| 4,633,953 | 1/1987 | LeBoeuf et al. | 166/358 |
| 4,643,614 | 2/1987 | Laursen | 405/169 |
| 4,721,412 | 1/1988 | King et al. | 405/195 |
| 4,735,526 | 5/1988 | Kawagoe et al. | 405/196 |
| 4,740,109 | 4/1988 | Horton | 405/224 |
| 4,754,817 | 7/1988 | Goldsmith | 175/7 |
| 4,784,529 | 11/1988 | Hunter | 405/227 |
| 4,893,965 | 1/1990 | Jordan | 405/202 |
| 4,907,657 | 3/1990 | Cox | 175/9 |
| 4,907,912 | 3/1990 | Smith | 405/208 |
| 4,913,238 | 4/1990 | Danazcko et al. | 166/350 |
| 4,934,871 | 6/1990 | Kazokas, Jr. | 405/224 |
| 4,966,495 | 10/1990 | Goldman | 405/195 |
| 4,972,907 | 11/1990 | Sellars | 166/353 |
| 4,973,198 | 11/1990 | Cox | 405/201 |
| 4,995,762 | 2/1991 | Goldman | 405/195 |

FOREIGN PATENT DOCUMENTS

WO85/01927 5/1985 PCT Int'l Appl. .

OTHER PUBLICATIONS

"Conoco Readies Jolliet TLWP for Nov. 1 Startup", Ocean Industry pp. 17–21, Oct., 1989.

"Field Experience Proves Semisubmersible Drilling Tender Concept", by H. I. Knecht and M. E. Nagel, Offshore, Sep. 1990, pp. 56–57.

"Minifloater: A Deepwater Production Alternative", Kerckhoff et al, Ocean Industry, Sep. 1990, pp. 147–152.

"Semisubmersible Drilling Tender Unit" by James E. Chitwood and Alan C. McClure, SPE Drilling Engineering, Jun. 1987.

*Primary Examiner*—David H. Corbin

*Attorney, Agent, or Firm*—Mark A. Smith

[57] ABSTRACT

A method are disclosed for establishing hydrocarbon production for offshore reservoirs in which a compliant platform is installed at a selected site, an offshore drilling vessel is docked to the compliant platform and the vessel is positioned over a selected well site for conducting drilling operations, and the production riser is transferred from the vessel to the compliant platform and secured there. Communication between a surface tree installed on the production riser and facilities supported by the compliant platform is established and these steps are repeated for each selected well site served by the compliant platform.

62 Claims, 12 Drawing Sheets

40
42
40A
48
30
60A
10
10A
26
24
12
22
50
50
60
20
54
52
46
16
28
44
44A
14
44

1E 1E
42
48
10

10
42
48

FIG. 2
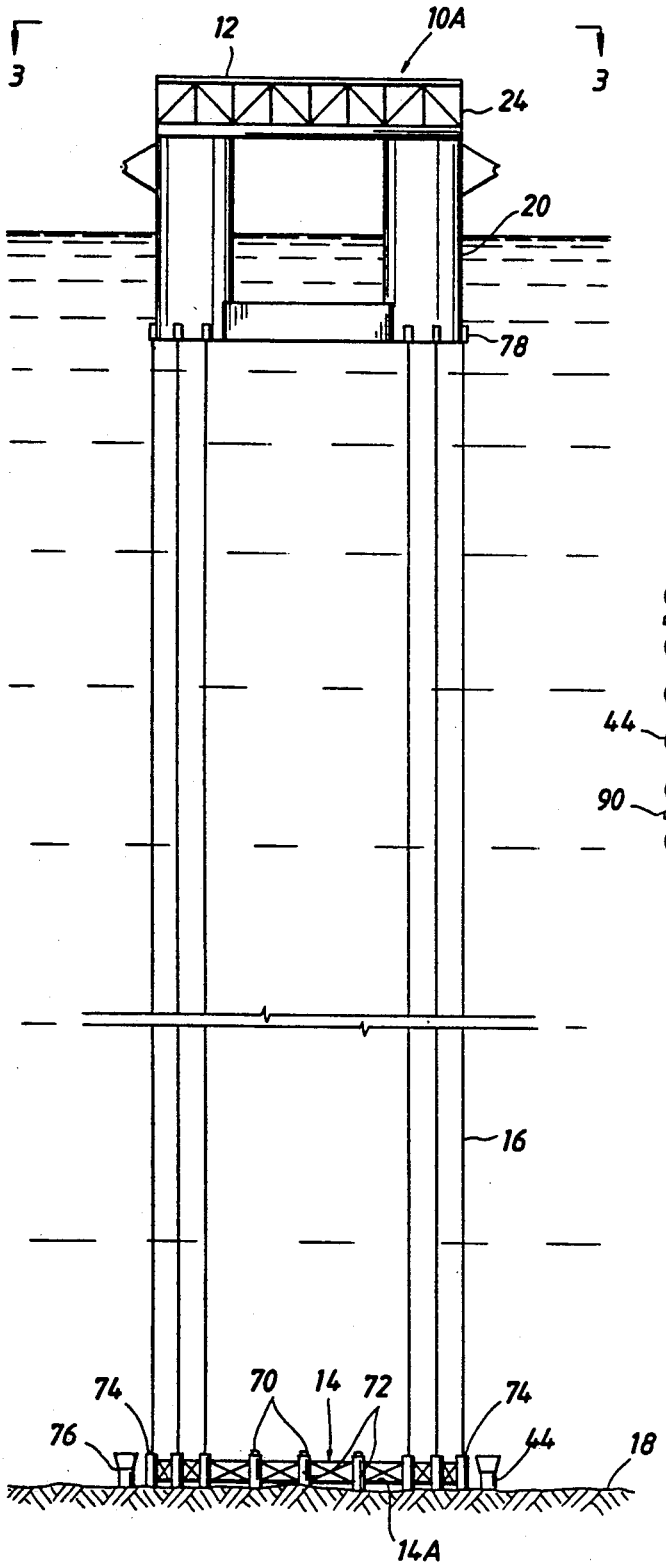
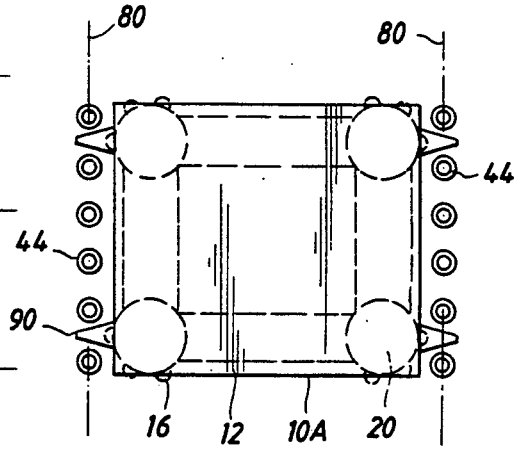
FIG. 3

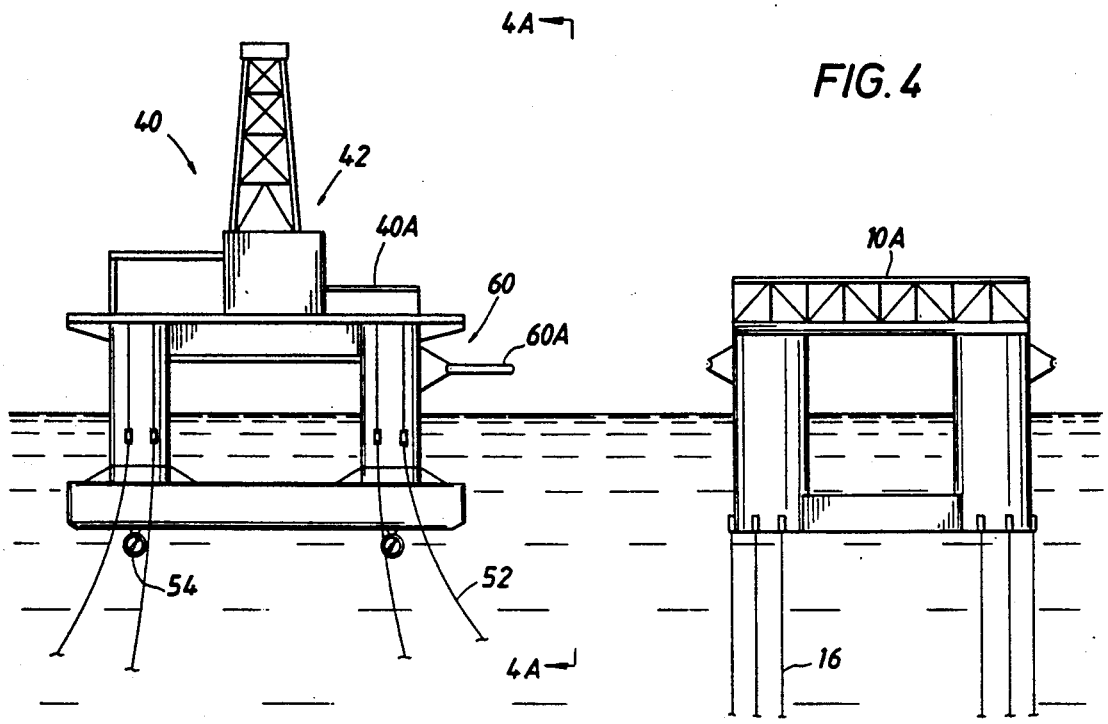
FIG. 4
FIG. 4A
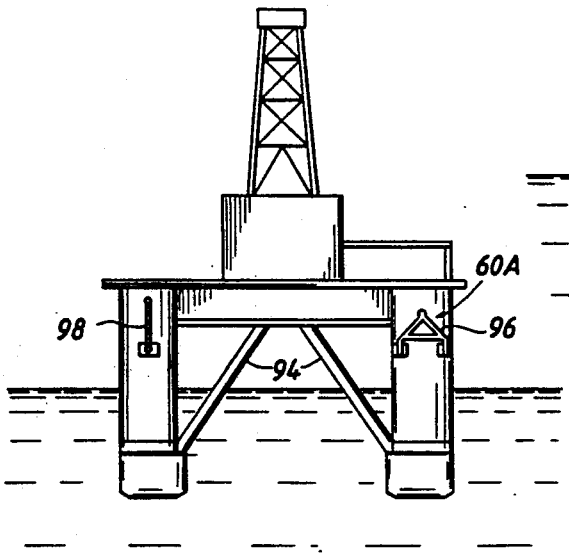
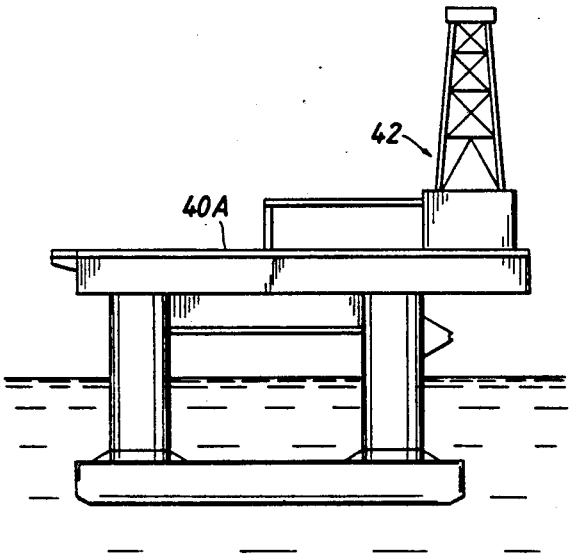
FIG. 4B 52
40A
96
90A
10A
90
60
98
60
52

80
52
80
96
40A
90A
10A
90
60
60
98
90B
10
90
40
52

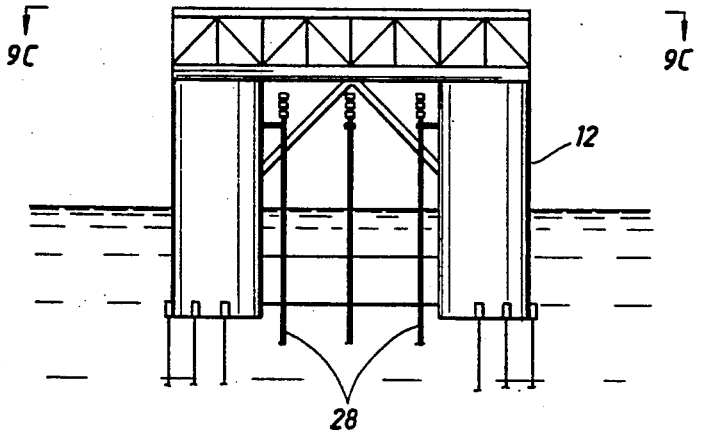
FIG.9B
FIG.9C
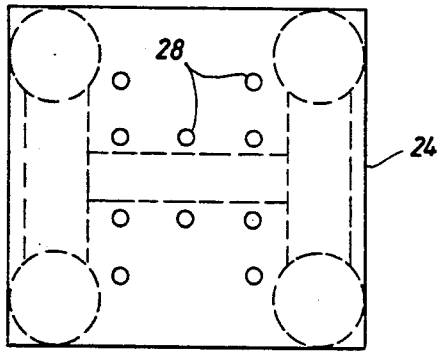
FIG.9D
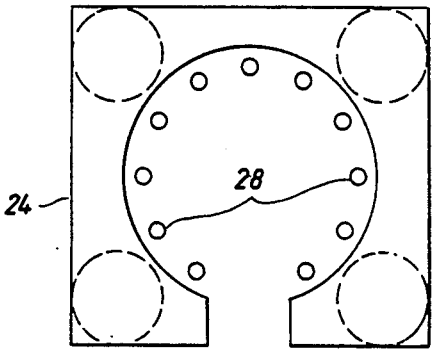
FIG.10
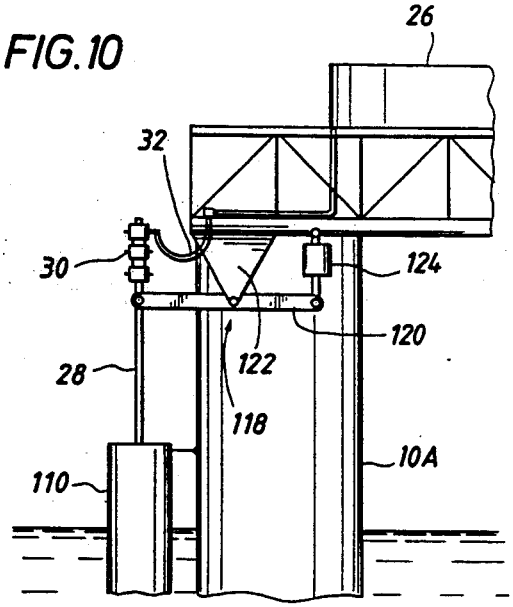
FIG.10A
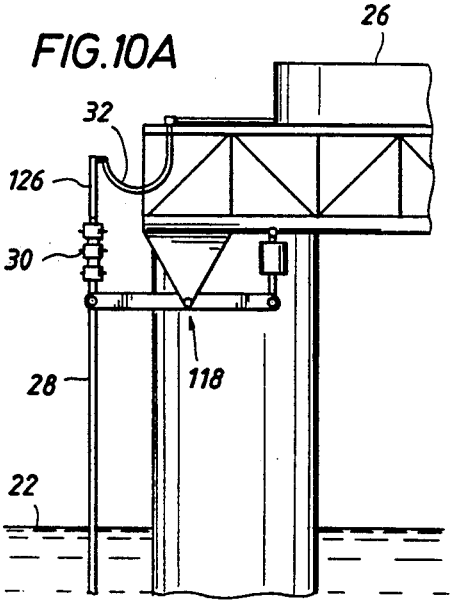

METHOD AND SYSTEM FOR DEVELOPING OFFSHORE HYDROCARBON RESERVES

This is a continuation of application, Ser. No. 624,864, filed Dec. 10, 1990, now abandoned.

BACKGROUND OF THE INVENTION

The present invention relates to a method and apparatus for establishing, maintaining and accelerating hydrocarbon production from offshore reservoirs. More particularly, the present invention relates to a method and system for economically developing deepwater oil and gas prospects with surface accessible completions.

Traditional bottom-founded platforms having a fixed or rigid tower structure have been taken to their logical depth limits in the development of offshore oil and gas reserves. Economic considerations suggest that alternatives to this traditional technology be ordinarily used in waters deeper than about 1200 feet in the Gulf of Mexico and often less in other areas. Further, even the most promising reservoirs are difficult to economically exploit in this manner at any greater depth.

One alternative to fixed towers is to drill from facilities provided on surface vessels and to complete the wells at the ocean floor with subsea completions. Gathering lines connect the subsea wells to facilities usually located at the surface, either in the immediate vicinity or provided remotely in a satellite operation.

However, subsea wells are relatively inaccessible at the ocean floor and this fundamental problem is exacerbated by the rigors of the maintenance-intensive subsea environment. The result is complex, costly maintenance operations which are difficult to accomplish with either through-flow line tools or the remotely operated vehicles or manned submarines suitable for deepwater applications. Further, maintenance is impossible for divers in all but the most shallow of deepwater applications and even there it is both dangerous and difficult work.

Alternatively, deepwater wells can be provided with surface completions on specialized structures more suitable for deepwater applications. Designs have been developed for various configurations of tension leg, compliant tower, and articulated tower platforms as well as floating production systems which can provide drilling and production facilities in deepwater at costs not possible for traditional fixed platforms. Nevertheless, the high cost of these structures requires a high concentration of wells in traditional practice in order to be economically feasible. Many hydrocarbon reservoirs cannot effectively utilize, and therefore justify, such a number of wells. Other reservoirs can justify the number of wells, but only if extended reach drilling techniques are used to drain relatively remote areas of the reservoir from the facilities provided on the platform. This extended reach can be accomplished with the current directional and horizontal drilling techniques, but only by substantially increasing the drilling cost for the wells so extended.

The cost of deepwater platforms further increases if the drilling operations are to be conducted from the platform itself. This substantially increases the load on the platform, thereby requiring a substantially larger structure. Further, primary drilling operations to develop a dispersed reservoir with extended reach techniques from a central location can spread the drilling operations over many years. Subsequent well workover operations may tie the drilling rig to the platform many years thereafter even though primary drilling is complete. Both aspects represent economic inefficiencies. In the first instance, drilling such extended reach wells, one well at a time, delays and defers production, thereby adversely affecting the rate of return of the substantial capital expenditures necessary to provide such a deepwater structure. Further, after the wells have been drilled, the rig represents a very substantial asset which cannot otherwise be efficiently used and has similarly permanently committed the prospect to the larger structure, thereby affecting the cost of the platform as well.

Alternatively, the wells can be predrilled from a drill ship or other floating facility, killed or otherwise secured, and completed from a scaled-down "completion" rig carried on a production platform such as a tension leg well platform (TLWP) installed at the site later. This reduces the load on the permanent facilities and therefore permits a smaller platform, but prevents production from any well until all the wells have been drilled and thereby substantially defers revenue from the development. Further, this scheme does not allow the flexibility to permit additional or replacement drilling once the platform has been installed.

Efficient development of deepwater hydrocarbon reserves must overcome these deficiencies and provide a method and system for developing the reservoirs with lower capital outlays, faster return on investment, more efficient reservoir management for larger reservoirs, and enhanced profitability for reservoirs that are otherwise marginal.

SUMMARY OF THE INVENTION

It is an object of the present invention to economically provide surface access for offshore oil and gas wells, especially in deepwater.

It is a further object of the present invention to provide a system and method for drilling oil and gas wells in deepwater in a manner affording surface completion without dedicated drilling facilities which will often sit idle during the production phase of the development.

Another object of the present invention is to economically afford a more efficent distribution of surface-accessible wells over a deepwater reservoir in a manner affording multiple drilling opportunities with a plurality of platforms spaced over the reservoir and connected by pipelines.

Finally, it is an object of the present invention to provide minimal platforms supporting surface well completions which also afford an opportunity for additional development drilling as well as maintenance work on existing wells.

Toward the fulfillment of these and other objects, a method and system for establishing hydrocarbon production for deepwater offshore reservoirs is provided which comprises installing a compliant platform at a selected site, docking an offshore drilling vessel to the compliant platform and positioning the vessel over a selected well site, conducting drilling operations, transferring the production riser from the vessel to the compliant platform, securing the production riser to the complaint platform through a dynamic tensioning device and establishing communication between a surface tree installed on the production riser and facilities supported by the compliant platform. These steps are repeated for each selected well site served by the compliant platform.

Thus, the method and system of the present invention allows surface accessible completions hung on a deepwater compliant platform that does not have to be scaled to accommodate the weight of a major drilling rig and which utilizes drilling facilities supplied by an offshore drilling vessel which can relocate those facilities when no longer needed at the platform.

BRIEF DESCRIPTION OF THE DRAWINGS

The brief description above, as well as further objects, features and advantages of the present invention will be more fully appreciated by reference to the following detailed description of the preferred embodiments which should be read in conjunction with the accompanying drawings in which:

FIG. 2 is a side elevation view of a TLWJ suitable for use in the practice of the present invention;

FIG. 3 is a top plan view of the TLWJ of FIG. 2 take along line 3—3 of FIG. 2;

FIG. 4 is a side elevation view of a semisubmersible vessel approaching a compliant platform in accordance with the present invention;

FIG. 4A is a front elevation view of the semisubmersible vessel of FIG. 4 taken along the line 4A—4A;

FIG. 4B is a side elevation view of an alternate embodiment of a semisubmersible vessel in which the drilling facilities are positioned on a cantilevered section of the deck;

FIG. 9B is a side elevation view of an alternate embodiment of a compliant platform having laterally accessible means for receiving production risers in accordance with the present invention;

FIG. 9C is a top plan view of the compliant platform of FIG. 9B taken along line 9C—9C in FIG. 9B;

FIG. 9D is an overhead plan view of an alternate embodiment of a compliant platform having laterally accessible riser receiving means in accordance with the present invention;

FIG. 10 is a side elevation view of a production riser being secured to the compliant platform in accordance with the present invention;

FIG. 10A is a side elevation view of a production riser being brought into communication with facilities supported by the compliant platform in accordance with the present invention;

DETAILED DESCRIPTION OF PREFERRED EMBODIMENTS

Figure 1:
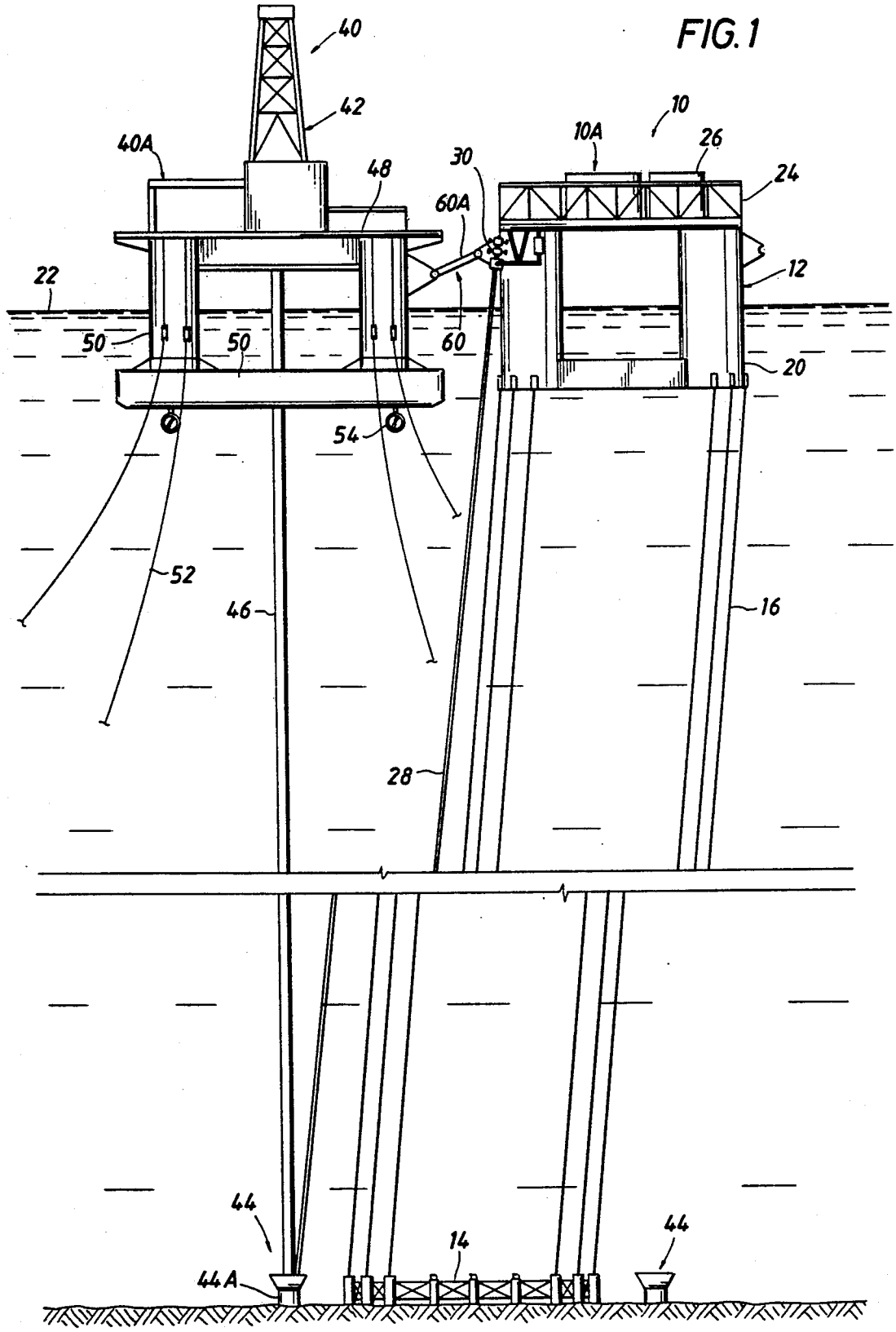
FIG. 1 is a side elevation view of a preferred embodiment of the present invention in which a semisubmersible vessel is conducting drilling operation adjacent a tension leg well jacket ("TLWJ")

FIG. 1 is a side elevation view of drilling operations in support of establishing hydrocarbon production from a deepwater offshore reservoir in a manner consistent with the present invention. Compliant platform 10 is docked to offshore drilling vessel 40, here a semisubmersible vessel 40A.

In the illustrated embodiment, compliant platform 10 is provided by a tension leg well jacket ("TLWJ") 10A which has a floating superstructure 12 secured to a foundation 14 with a plurality of tendons or tension legs 16 which draw buoyant hull 20 of superstructure 12 below its free-floating draft at ocean surface 22. Hull 20 supports a deck 24 which carries processing facilities 26.

Semisubmersible vessel 40A is illustrated conducting drilling operations with derrick and related drilling facilities 42 supported on deck 48 which is in turn supported by pontoons, columns or other buoyant members 50. The derrick of the semisubmersible vessel is positioned over one of the well sites 44, here at well site 44A, using a catenary mooring system 52 or dynamic positioning thrusters 54 and drilling operations are conducted through a drilling riser 46. A production riser 28 of a previously drilled well is supported by TLWJ 10A with the valve assembly of the surface completion of Christmas tree 30 supported above the ocean's surface.

Offshore drilling vessel 40 interfaces with compliant platform 10 through a restraining system 60, here provided by a means 60A for docking the semisubmersible vessel to the tension leg well jacket. The restraining system of the preferred embodiment is discussed in further detail hereinbelow.

A full range of different compliant platforms can be adapted for use in the practice of the present invention and FIGS. 1A through 1E represent a sample of the breadth of some important aspects of this invention.

Figure 1A:
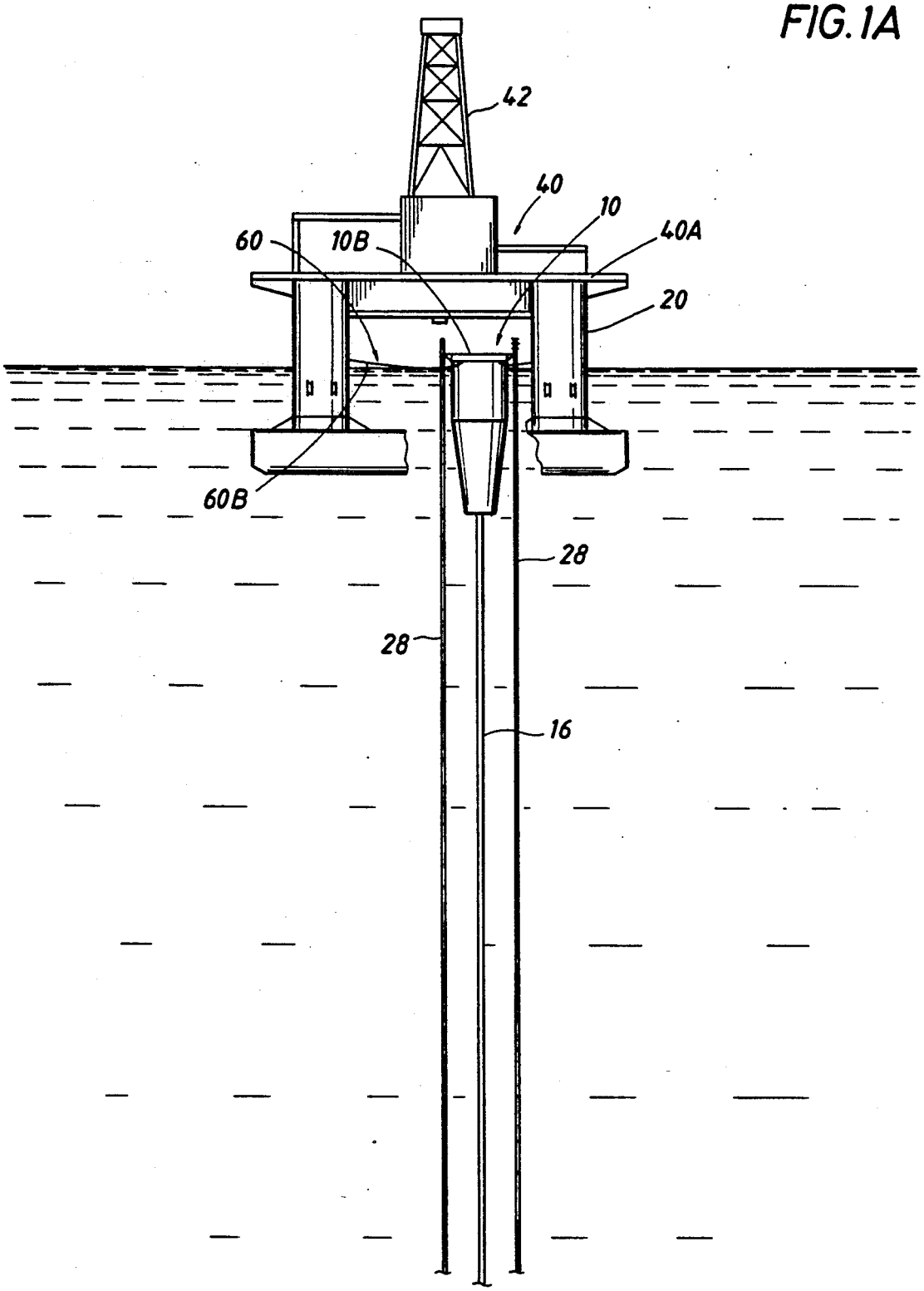
FIG. 1A is a side elevation view of an alternate embodiment of the present invention in which a semisubmersible vessel is conducting drilling operations over a monopod compliant platform.

FIG. 1A discloses an alternate embodiment of the present invention in which compliant platform 10 is a single column TLWJ or "monopod" 10B installed to the ocean floor with one or more tendons 16 and offshore drilling vessel 40 is a semisubmersible vessel 40A configured to ride over the installed monopod. The monopod is held in position with respect to the semisubmersible vessel by restraining system 60, here a set of guylines 60B. However, drilling operations are conducted substantially in place through a drilling riser supported by the semisubmersible vessel. After completion of drilling operations, the drilling riser is replaced with a production riser 28 which, in the preferred practice, is secured to the monopod before completion operations. In FIG. 1A, the semisubmersible vessel is positioned with derrick 42 directly over the production riser through which completion operations will be conducted. A previously drilled and completed well is illustrated with another production riser 28 also supported by monopod 10B. The monopod structure could alternatively be any structure small enough to fit inside the semisubmersible vessel's lower hull components.

Figure 1B:
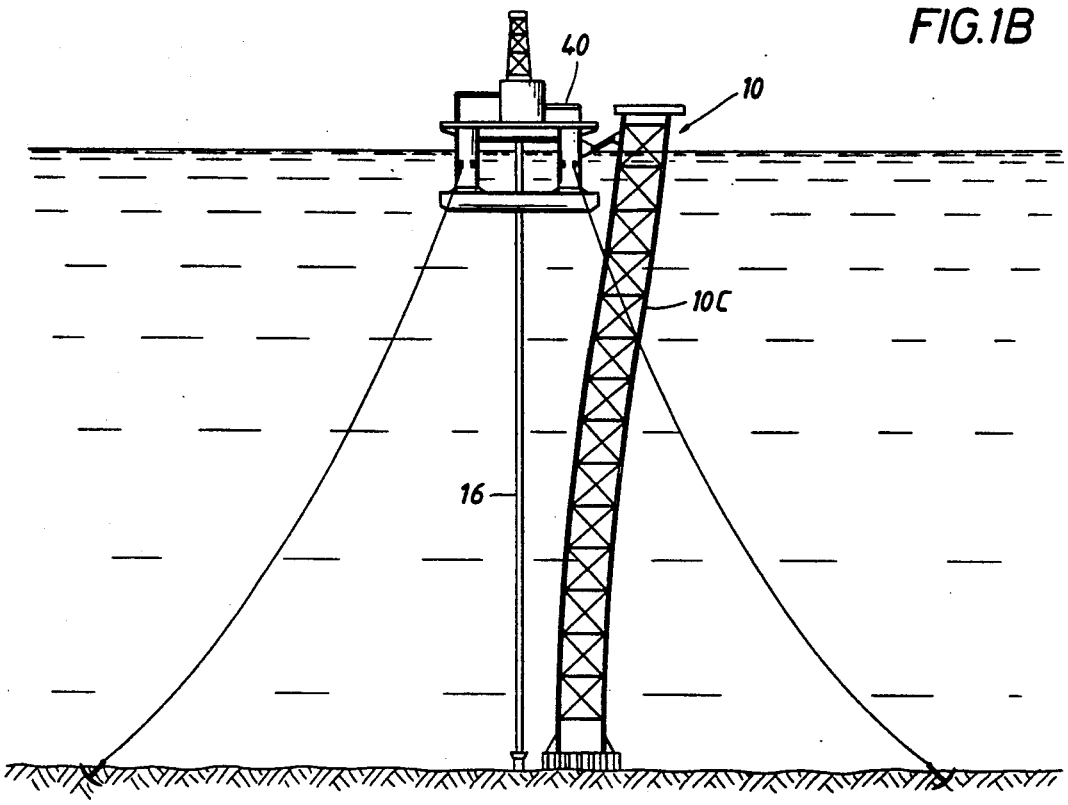
FIG. 1B is a side elevation view of an alternate embodiment of the present invention in which a semisubmersible vessel is conducting drilling operations adjacent a compliant tower platform.

FIG. 1B is an alternate embodiment of the practice of the present invention in which compliant platform 10 is provided by a compliant tower 10C which is assisted by drilling from offshore drilling vessel 40.

Figure 1C:
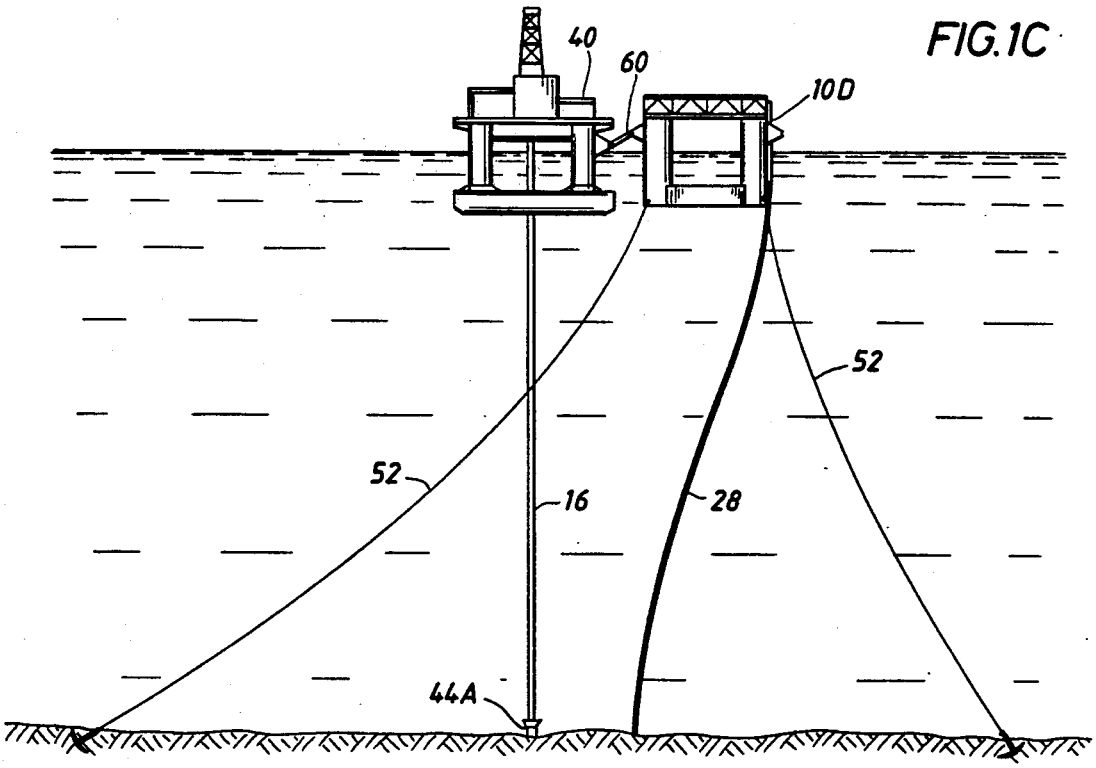
FIG. 1C is a side elevation view of an alternate embodiment of the present invention in which a semisubmersible vessel is conducting drilling operations adjacent a floating production system ("FPS")

FIG. 1C is an alternate embodiment of the present invention in which an offshore drilling vessel 40 is connected through a restraining system 60 to a floating production system 10D which has its own positioning system with catenary mooring lines 52. In this embodiment the floating production system is positioned so that the offshore drilling vessel connected to it will be brought into place over a selected well site 44A for drilling operations.

Figure 1D:
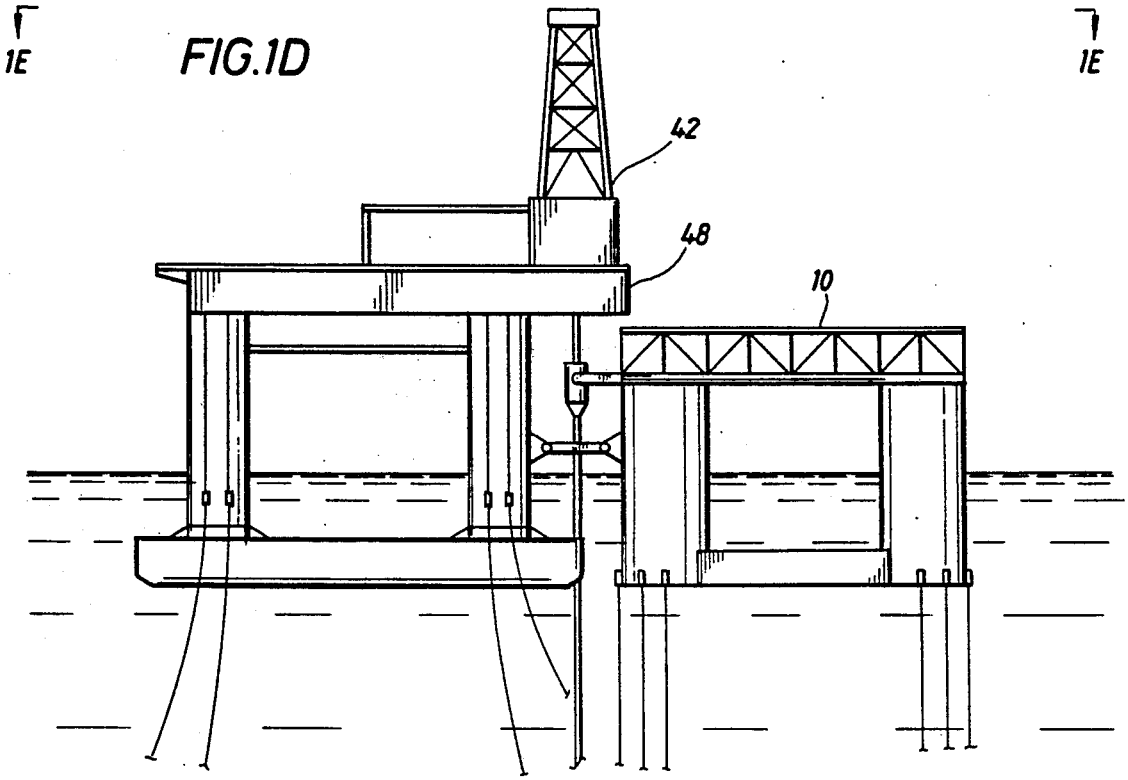
FIG. 1D is a side elevation view of an alternate embodiment of the present invention in which a semisubmersible vessel is conducting completion operations from a derrick on a cantilevered deck through risers installed on a tension leg well jacket ("TLWJ")
Figure 1E:
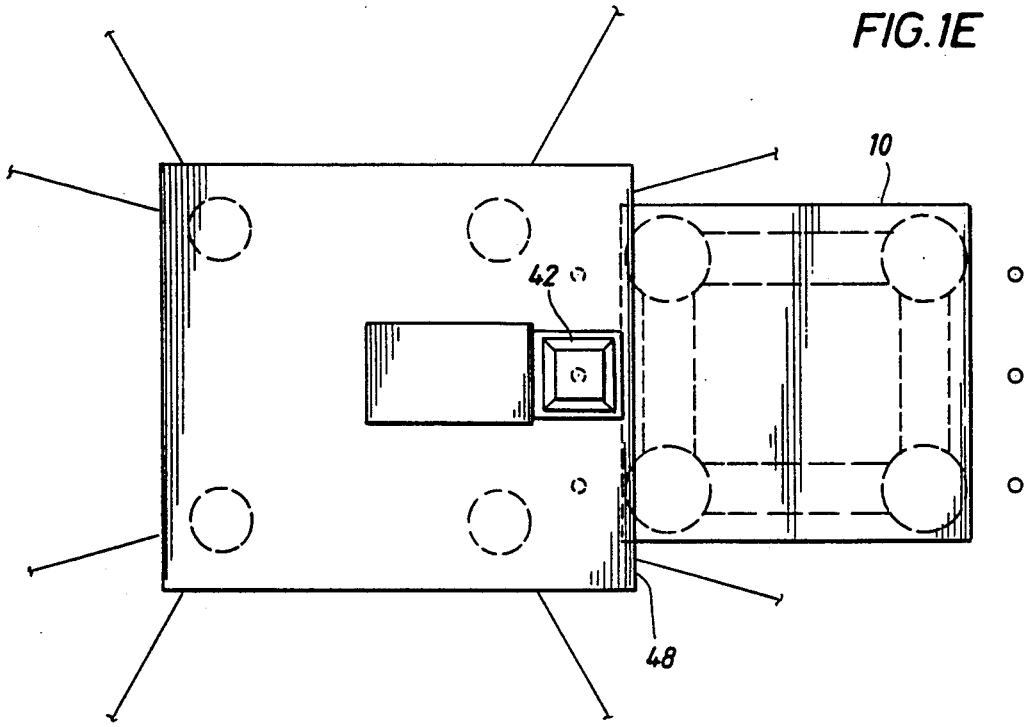
FIG. 1E is a top plan view of the semisubmersible vessel and TLWJ of FIG. 1D taken along line 1E—1E of FIG. 1D.

FIGS. 1D and 1E illustrate the use of a cantilevered end bay semisubmersible vessel configured to bring a derrick to a position immediately adjacent the compliant platform and conduct drilling operations through a drilling riser supported by the vessel. This arrangement of a cantilevered deck 48 to allow positioning of derrick and related drilling facilities 42 permits drilling with little or no displacement of compliant platform 10. After completing the drilling operations, the drilling riser is replaced with a production riser which, preferably, is connected to the compliant platform for completion operations with the drilling facilities of the semisubmersible vessel.

The practice of the present invention begins with installation of a compliant platform. A "compliant" platform is any offshore surface facility designed to "give" in a controlled manner with environmental loading rather than rigidly resist such force. This basic design precept distinguishes the fixed or rigid bottom-founded towers which require vast amounts of structural materials for extension into deepwater. Many basic configurations of compliant platforms have been proposed including articulated towers, compliant towers, compliant piled towers, TLP's, etc., a sampling of which are illustrated in the FIG. 1 series discussed above. However, any basic configuration which is favorably economically sensitive to load reductions and which can be adapted to receive laterally transferred production risers can be used in the practice of the present invention. FIGS. 2 through 11 illustrate the practice of the present invention using a tension leg well jacket ("TLWJ"), but those skilled in the art and familiar with the teachings of this application could apply this practice to any other basic compliant platform configuration.

FIGS. 2 and 3 illustrate a TLP configuration which is especially suited for the practice of the present invention. This compliant platform is a tension leg well jacket ("TLWJ") 10A which comprises a minimal TLP without drilling capabilities, and, at most, modest workover capabilities. The TLWJ is designed to exteriorly receive and secure production risers passed from the offshore drilling vessel (not shown here), preferably into an above-water, outboard well bay, see FIG. 10. FIG. 2 is a side elevation view of the TLWJ and FIG. 3 is an overhead view. These figures illustrate the same TLWJ pictured during drilling operations in FIG. 1.

Installation of TLWJ 10A begins by placing foundation 14, here supplied by unitary template 14A. The foundation is then secured to ocean floor 18. In the illustration, a plurality of piles 70 are driven into the ocean floor through pile sleeves 72 of the foundation and the piles are then secured to the pile sleeves with grouting or swaging operations. Other well known means for anchoring the foundation to the ocean floor may also be suitable. The foundation provides a means 74 for connecting tendons 16 and may include well guides 76 which are placed at well sites 44 adjacent the foundation. In the illustration, the well guides are placed independently and are not connected to the template. In some instances it is desirable to predrill some of the wells.

Superstructure 12 comprising buoyant hull 20 and deck 24 is towed to location and ballasted down. Tendons 16 are installed between means 74 for connecting the tendons to the foundation and means 78 for connecting the tendons 16 to floating superstructure 12. The tendons are initially tensioned during installation and deballasting of buoyant hull 20 further tensions the tendons to provide additional excess buoyancy to the TLWJ as necessary to produce the desired behavior under all loading conditions.

Desired well sites 44 are aligned in well lines 80 adjacent TLWJ 10A as best depicted in FIG. 3. Provisions are discussed below which facilitate laterally receiving and securing production risers transferred from an offshore drilling vessel. Another feature of the illustrated TLWJ is a plurality of docking supports 90, the purpose and function of which will become apparent in the discussion of the docking procedures illustrated in FIGS. 5 and 6.

FIG. 4 illustrates deployment of offshore drilling vessel 40 adjacent installed TLWJ 10A. The offshore drilling vessel is a floating structure which carries a derrick, drawworks and related drilling facilities 42. Further, the term "offshore drilling vessel" is intended to cover any transportable, floating facilities capable of supporting well operations such as drilling, completion, workover, well repair or abandonment. Preferably these facilities are provided in a substantially open design adapted for stability in deepwater drilling applications. Semisubmersible vessels represent a class of vessels well suited to this application and have been used throughout to generally illustrate the practice of the present invention.

Semisubmersible vessel 40A in FIG. 4 is maneuverable by either catenary mooring lines 52 or dynamic positioning thrusters 54. For purposes of this embodiment, the catenary mooring lines are deployed and anchored in a spread about the semisubmersible vessel which overlaps the position of the TLWJ. Semisubmersible vessel 40A can then be maneuvered with respect to TLWJ 10A by playing out and retrieving selected catenary mooring lines 52.

FIG. 4A illustrates adaptation of conventional semisubmersible vessels to facilitate practice of the present invention. This Figure shows the end of semisubmersible vessel 40A of FIG. 4 which will approach the TLWJ. Certain conventional semisubmersible vessel configurations can be "opened up" to provide lateral access from beneath the semisubmersible vessel by removing a horizontal brace conventionally placed between the pontoons and reinforcing the remaining structure, such as with diagonal struts 94. If desired, provisions may be undertaken to allow the horizontal brace to be selectively removed for riser transfer operations, yet provide stability in place during transport and, perhaps, during drilling operations.

Another modification of conventional semisubmersible vessels necessary to best facilitate the practice of the invention is installation of a restraining system 60, which in this embodiment is provided by a means 60A for docking which comprises a hinged docking frame 96 and a hinged docking strut 98.

FIG. 4B illustrates an alternative to modifying a conventional semisubmersible vessel for practice with the present invention. A special purpose semisubmersible vessel having a cantilevered deck with an end well bay providing a derrick and attendant drilling facilities thereon will allow the docking and drilling operation generally illustrated in FIGS. 1D and E.

Figure 5:
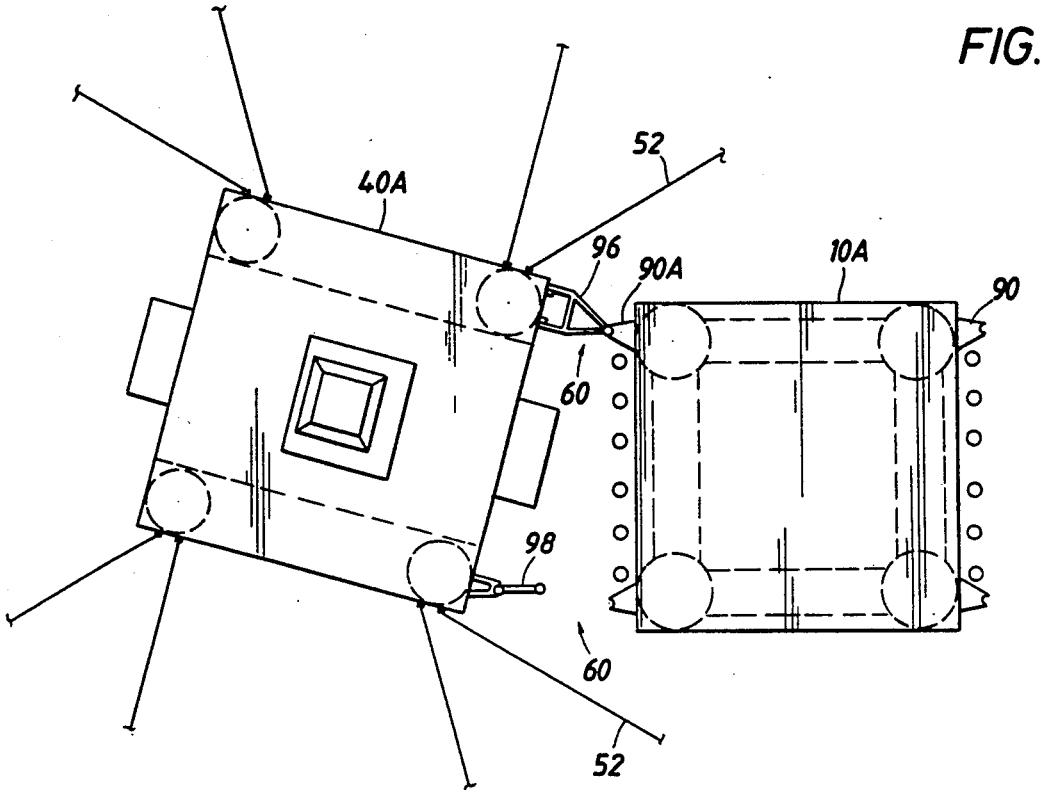
FIG. 5 is an overhead plan view of a semisubmersible vessel beginning docking operations with a compliant platform in accordance with an embodiment of the present invention.
Figure 6:
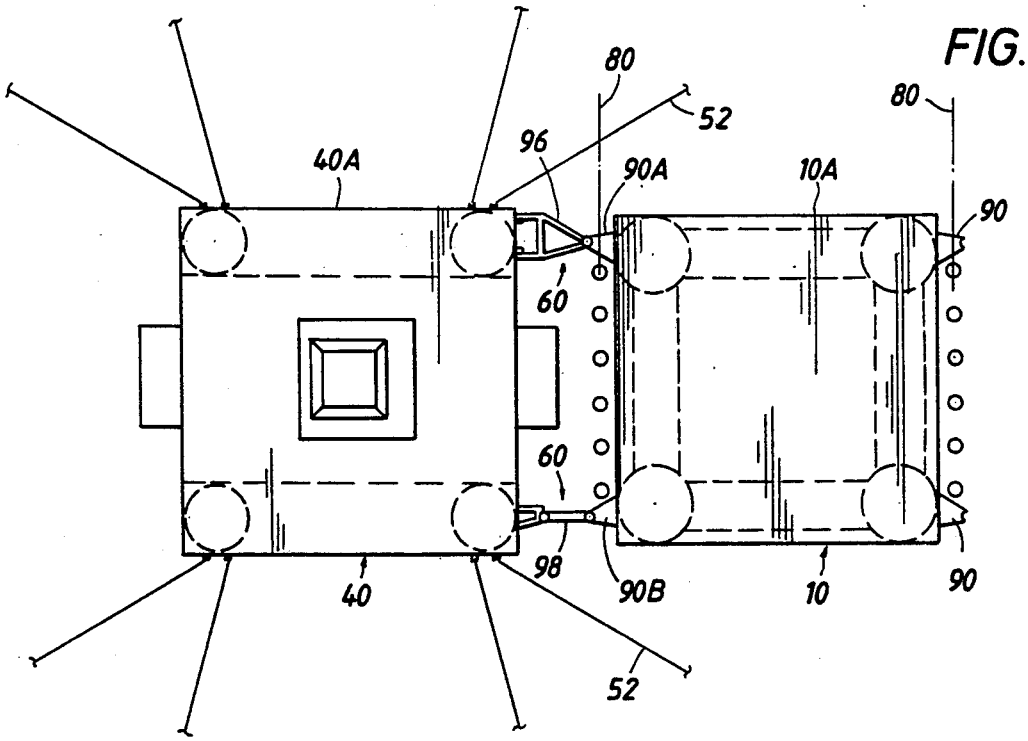
FIG. 6 is a top plan view of a semisubmersible vessel completing docking operations with a compliant platform in accordance with an embodiment of the present invention.

FIG. 5 illustrates the initiation of docking procedures between semisubmersible vessel 40A and TLWJ 10A. Catenary mooring lines 52 are adjusted to bring lowered docking frame member 96 adjacent docking support 90A on the TLWJ and a connection is made, e.g. by inserting a pin. The docking frame then secures the semisubmersible vessel to the TLWJ to produce a 2-degree of freedom restraint.

Catenary mooring lines are further adjusted to rotate the semisubmersible vessel 40A and bring lowered docking strut 98 into the position to connect with docking support 90B. See FIG. 6. Similarly, this connection can be secured with a pin or a multi-axis rotation connection and will provide a 1-degree of freedom restraint. This fully secures the offshore drilling vessel 40 to compliant platform 10 such that wave action will not cause collisions between the two.

Figure 7:
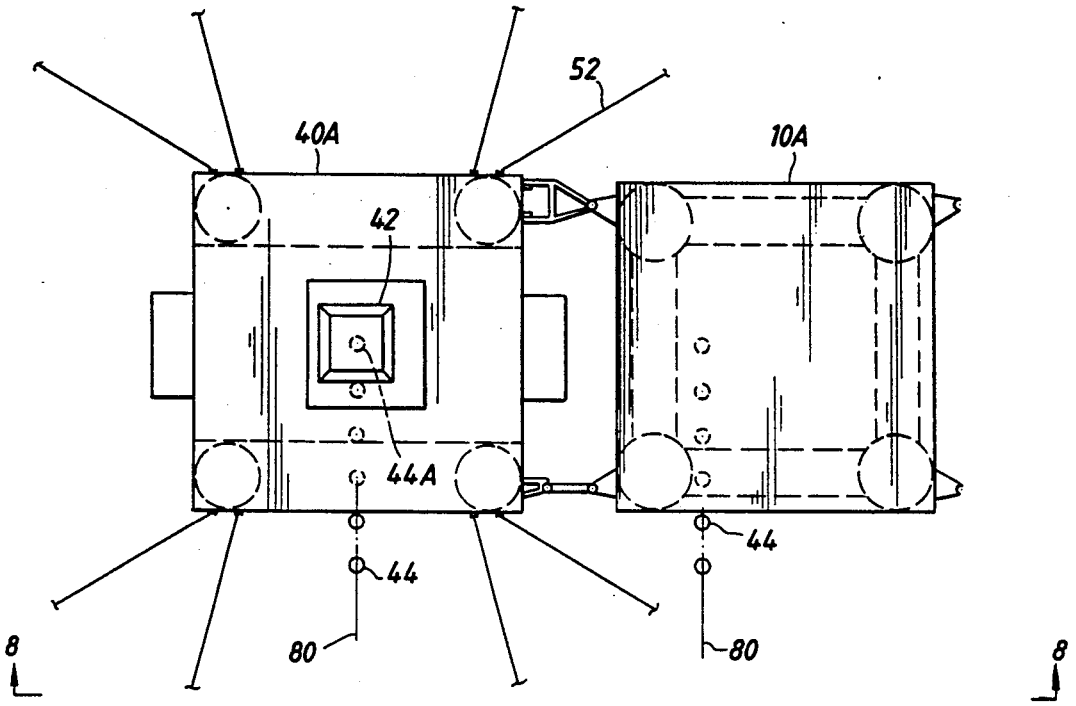
FIG. 7 is a top plan view of a semisubmersible vessel docked to a compliant platform and taking position for drilling operations over a selected well site in accordance with an embodiment of the present invention.
Figure 8:
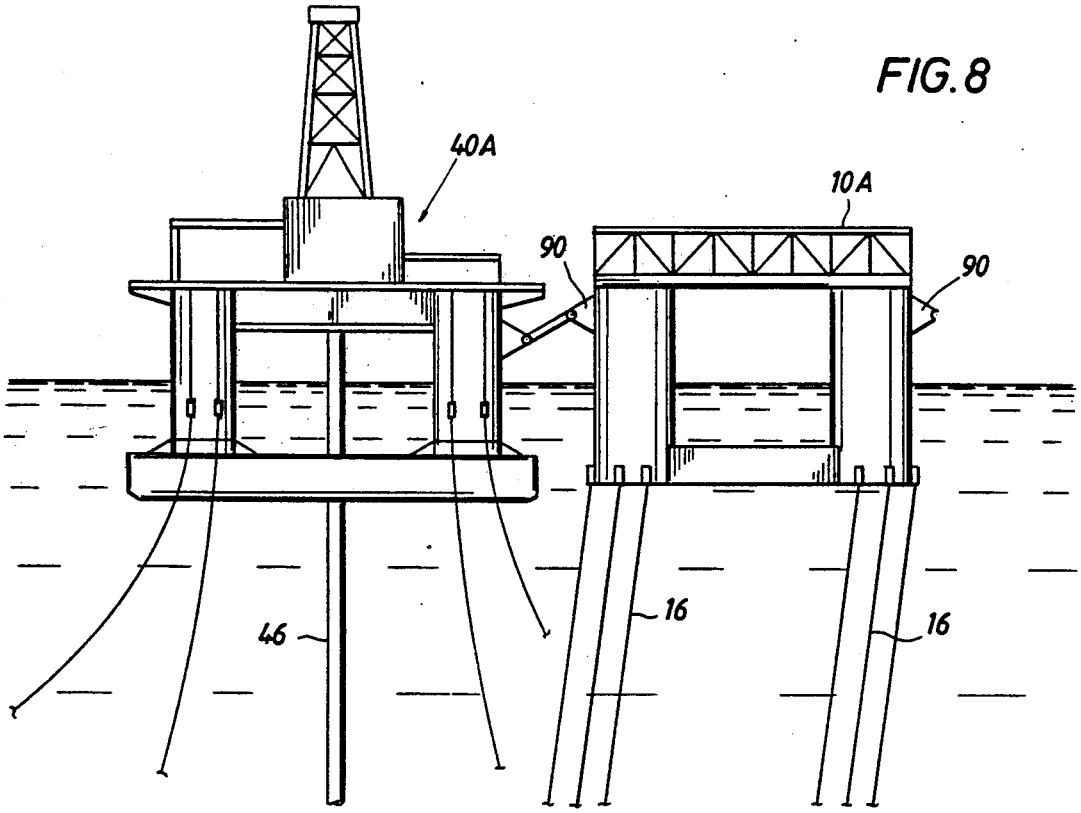
FIG. 8 is a side elevation view of a semisubmersible vessel docked with a compliant platform and conducting drilling operations in accordance with an embodiment of the present invention.

Docking also facilitates moving TLWJ 10A with positioning systems carried on semisubmersible vessel 40A. Compare FIG. 6 in which TLWJ 10A is normally centered between well lines 80 at the periphery of the TLWJ with FIG. 7 wherein the catenary mooring lines 52 have been adjusted to bias TLWJ out of alignment with its nominal position and to bring the derrick and related drilling facilities 42 into alignment with a selected well site 44A. The semisubmersible vessel of FIG. 7 is in position to initiate drilling or other well operations through a drilling riser 46 as further illustrated in FIG. 8. The drilling operations are best undertaken in substantially vertical drilling risers and the ability to shift compliant platform 10 slightly out of alignment with its nominal resting position in order to place the derrick over a selected well site substantially enhances drilling efficiency and reduces equipment wear. This ability also allows continuing drilling operations once the TLWJ is in place and thereby allows production to come onstream as soon as wells are completed, even as the drilling program proceeds.

FIGS. 1B and 1C demonstrate alternate embodiments for the compliant platform as provided by compliant tower 10C and floating production system 10D, respectively. There is also the reversal of the use of catenary mooring lines 52 with respect to the floating production system in FIG. 1C in which the floating production system is adjusted to place offshore drilling vessel 40 substantially vertically over a selected well site 44A.

After drilling operations are completed, drilling riser 46 is replaced with a lighter weight production riser 28 and the drilling facilities on offshore drilling vessel 40 are used through the production riser to complete the well. See FIG. 9. Alternatively, the same riser which serves as a drilling riser can serve as the production riser. After completion and installation of a surface completion or Christmas tree 30, a temporary buoyancy module 110 is installed about the production riser and the production riser is passed or transferred to compliant platform 10, here TLWJ 10A.

Figure 9:
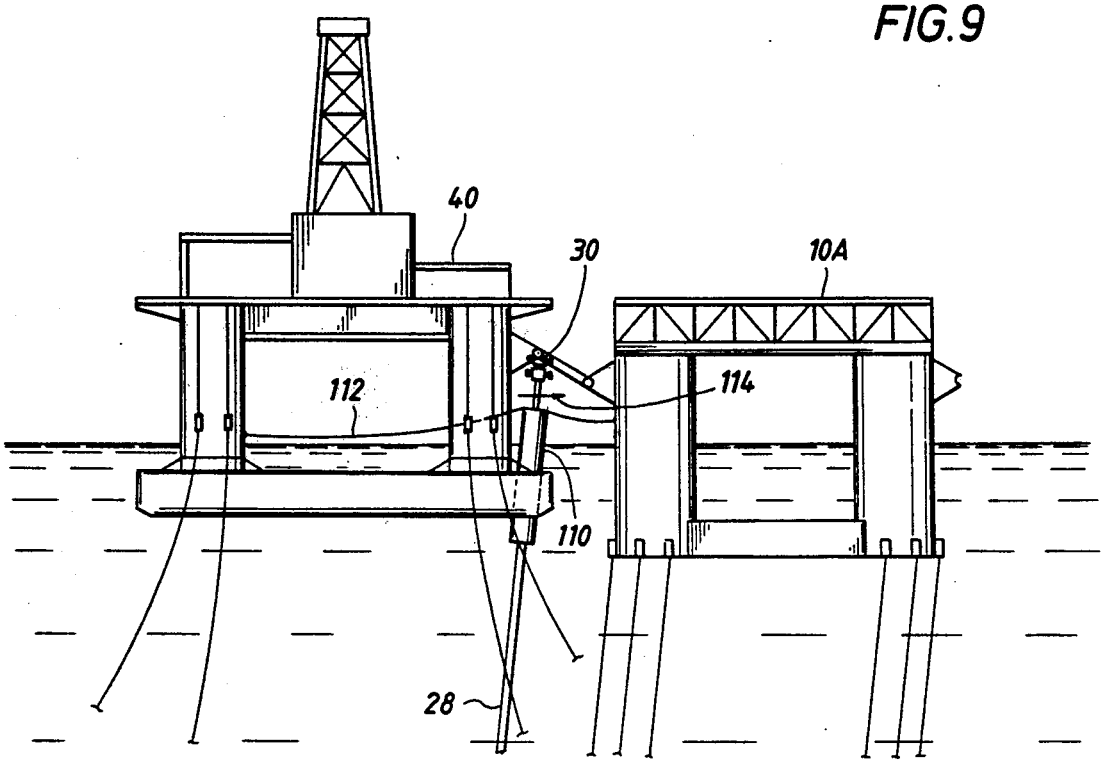
FIG. 9 is a side elevation view of a semisubmersible platform transferring a riser to a compliant platform in accordance with the present invention.
Figure 9A:
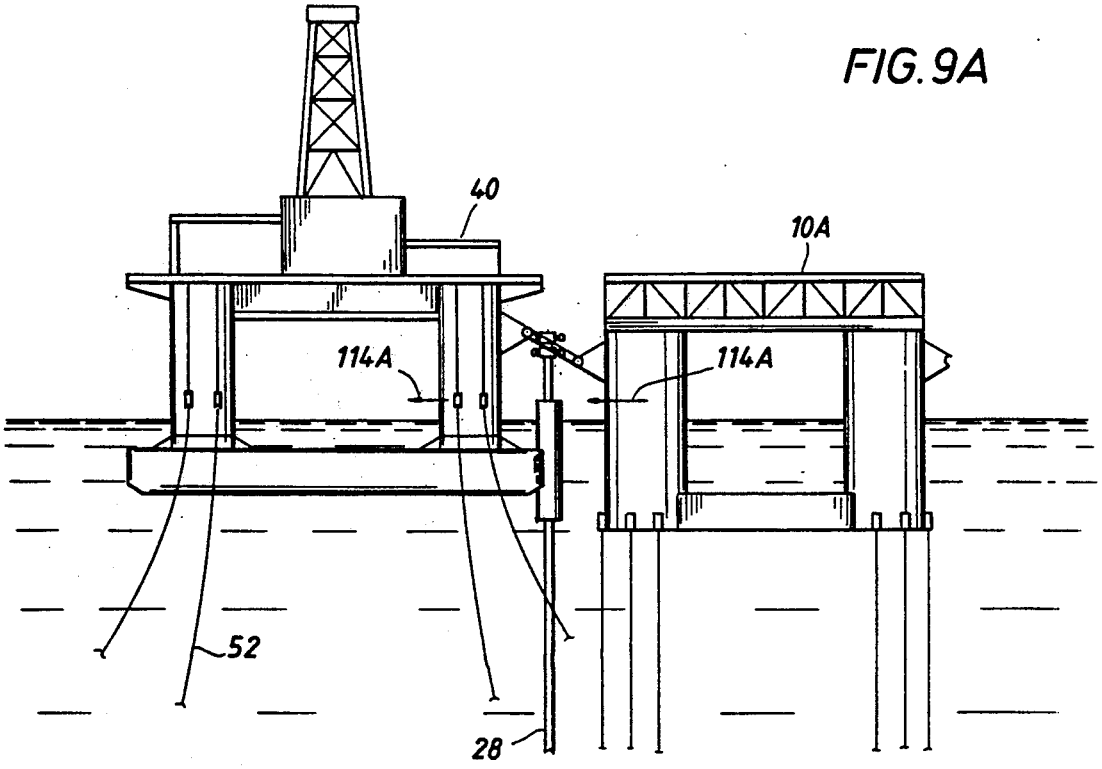
FIG. 9A is a side elevation view of an alternate embodiment of a semisubmersible vessel transferring a riser to a compliant platform in accordance with the present invention.

FIGS. 9 and 9A illustrate alternative methods for transferring the production riser. In FIG. 9, guylines 112 are used to draw production riser 28 to TLWJ 10A and arrow 114 illustrates this transfer. By contrast, FIG. 9A illustrates the use of the natural righting ability of temporary buoyancy module 110 to maintain production riser 28 in place while catenary mooring lines 52 are adjusted to bring TLWJ 10A into position to receive the substantially stationary production riser 28. Note arrows 114A. The presently preferred method for undertaking this transfer is a combination of both the embodiments of FIG. 9 and 9A.

A key aspect of the production riser transfer is that the compliant platform must be configured to laterally receive the production riser. FIGS. 9B, 9C and 9D show alternate embodiments for superstructure 12 of a tension leg platform. FIG. 9B and 9C illustrate one embodiment in which an H-shaped superstructure and a high deck permit placement of the production risers 28 underneath deck 24 in a position more sheltered than the peripheral placement in the embodiment of FIGS. 9 and 9A. FIG. 9D shows a "keyhole" deck which similarly allows laterally transferred production risers to be secured to the compliant platform at a sheltered position.

It may be desired to remove buoyancy device or module 110 from production riser 28 once the production riser has been secured to the compliant platform. Alternatively, buoyancy module 110 may be left on riser 28 to afford a measure of protection to the riser from surface hazards such as boat traffic or floating debris. This will also contribute substantially to the vertical support of the riser, thereby further reducing the required displacement of the TLWJ. See FIG. 10.

FIG. 10A illustrates the step of establishing communication between the surface completion of the production riser and the facilities on the compliant platform.

Preferably, the transferred production riser is secured to TLWJ 10A through a dynamic tensioning device 118. See FIG. 10. The dynamic tensioning device serves to maintain a substantially constant tension on production riser 28 despite motion of compliant platform 10 due to environmental forces. Many types of dynamic tensioning devices are suitable, including pneumatic, hydraulic, elastomeric, or combinations thereof. In some instances, such as where the risers are the same length as the tendons, dynamic tensioning devices may not be necessary. The tensioning device illustrated in FIG. 10 is well suited to receiving the laterally transferred production riser and includes a lever or rocker arm 120 connected to TLWJ 10A through fulcrum 122. A pressure charged elastomeric strut 124 provides the compensating force and is connected to one end of lever arm 120 and the production riser is attached at the other end of rocker arm 120 with a pivotal load connection. In the preferred embodiment, communication is established between the surface completion or Christmas tree 30 which is affixed atop the production riser 28 with a flexible flowline 32. Flowline 32 feeds the production fluids from production riser 28 to processing facilities 26. The processing facilities may be as simple as manifolds collecting the production fluids from a number of wells and distributing them to an export riser, or may include separation equipment for removing liquid products from gas produced or other various treatment systems to initially process the produced fluids into components more suitable for transport.

Another option illustrated in FIG. 10A is the use of a tree extension 126 which can elevate flexible flowline 32 above the wave zone adjacent ocean surface 22 in the event the semisubmersible configuration requires a low mounted Christmas tree 30 for the transfer operations.

Figure 11:
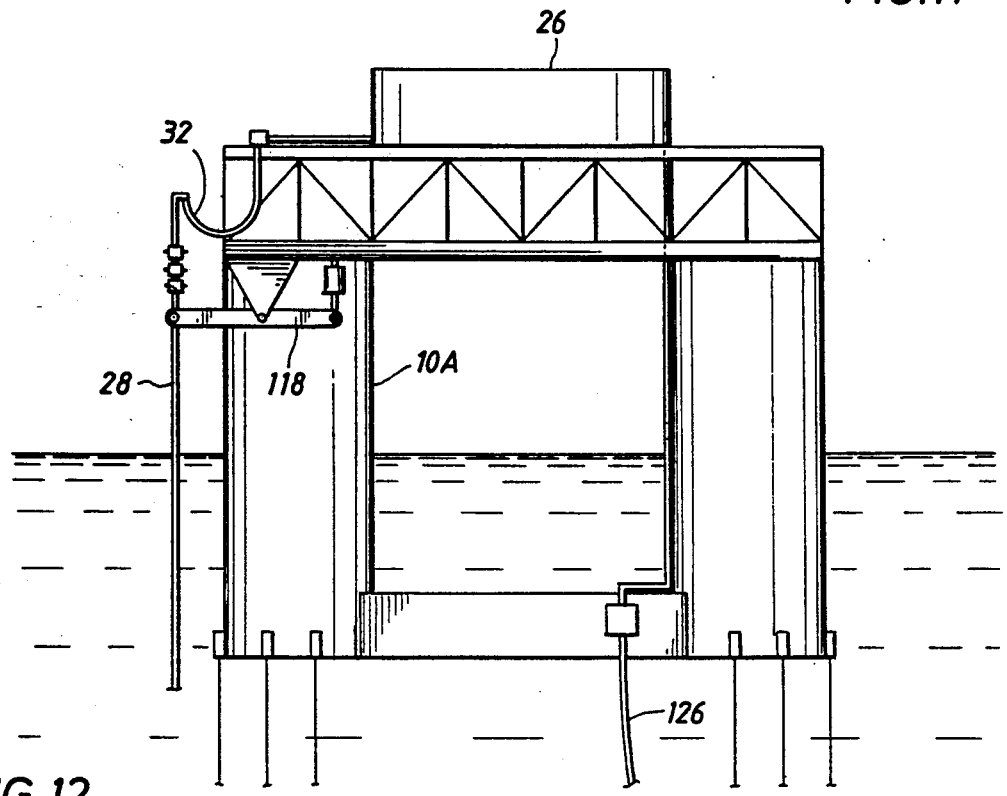
FIG. 11 is a side elevation view of a tension leg well jacket in the production mode in accordance with the present invention.

FIG. 11 illustrates TLWJ 10A in the production mode in which a plurality of production risers 28 are supported by TLWJ 10A through dynamic tensioning devices 118 and in which fluids produced from the well are carried up the production riser and to facilities 26 through flexible flowlines 32 for combination and/or treatment before export through a catenary export riser 128 to transport facilities such as a subsea pipeline (not shown).

Figure 12:
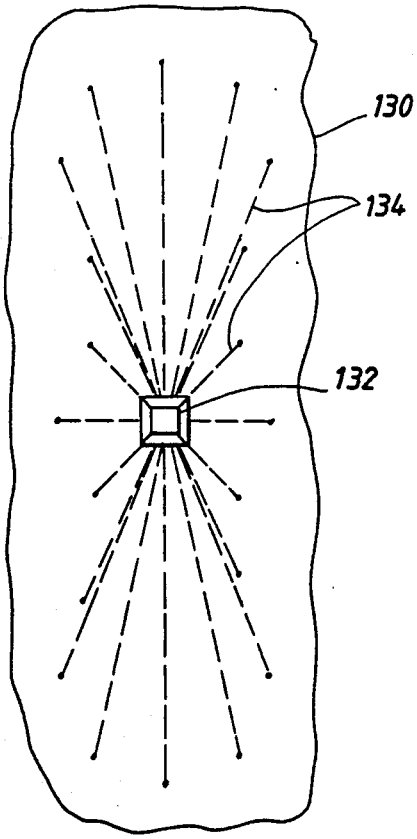
FIG. 12 (PRIOR ART)
FIG. 12 is an overhead view schematically illustrating the use in the prior art of central facilities to develop extended deepwater reservoirs.
Figure 13:
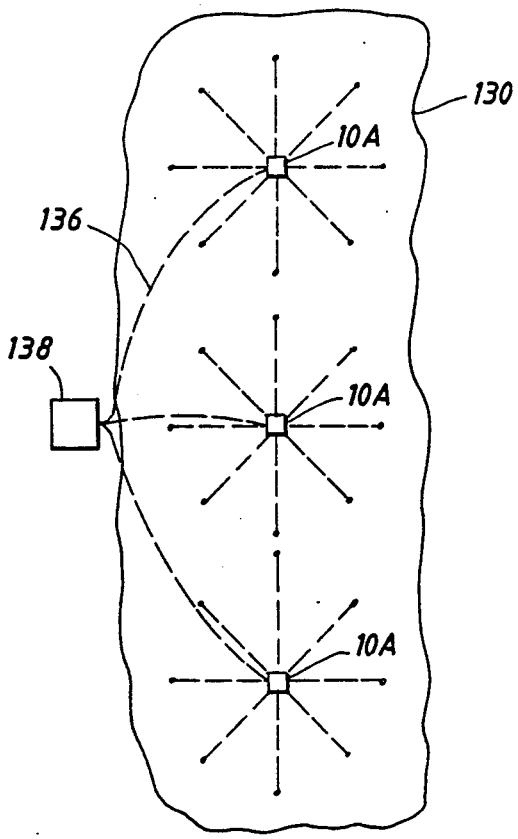
FIG. 13 is an overhead view schematically illustrating the use of satellite TLWJ's in accordance with the present invention.

FIGS. 12 and 13 demonstrate some of the potential advantages of practicing the present invention. FIG. 12 is a schematic diagram of a deepwater reservoir 130 developed conventionally such as through a central TLP 132. The extended reach drilling operations from the TLP must project horizontally a great distance in order to reach the far portions of the reservoir. The completed wells are designated by broken lines 134. These wells are drilled, one well at a time, over a number of years in order to establish the pattern illustrated. Production from later wells must be deferred until they can be reached. Further, the great horizontal reach defers completion of each well while, in effect, a lengthy underground pipeline is built for each well as the wellbore is cased and drilling proceeds. The large TLP structure necessary to support the drilling operations requires a very promising field and a great number of wells to prove economically attractive and, once completed, supports an idle drilling rig substantially through the remaining life of the field.

By contrast, the same deepwater reservoir 130 is illustrated in FIG. 13 in which satellite TLWJs 10A combine with a tension leg production facility 138 to provide a more rapid, more thorough, and more economical development of reservoir 130. FIGS. 12 and 13 depict approximately the same number of total wells, at approximately the same location. However, in FIG. 13, satellite TLWJs 10A are used with less extensive extended reach drilling to efficiently collect production fluids and, with only the most minimal processing, transfer the produced hydrocarbons to processing facility 138 through pipelines 136. The TLP of production facilities 138 may itself present exteriorly receiving well bays that may support additional wells 134 drilled with external facilities. In this illustration, three separate semisubmersible vessels may simultaneously conduct drilling operations to substantially shorten the completion time. Further, this system will afford the opportunity to have revenue streams from those wells that have been completed while additional wells are being drilled. The minimal tension leg well jacket, and process facilities on a central TLP that does not have to support drilling equipment, can be installed at a lower cost than the central TLP of the prior art which accommodates drilling from the TLP. Further, after drilling is complete, the semisubmersible vessels may be put into useful service elsewhere until needed for workover operations. Thus, the present invention reduces capital outlay, accelerates cash flow, increases the rate of return on the investment, and avoids the capital expenses associated with providing a full capability drilling rig dedicated for workover operations.

Figure 14:
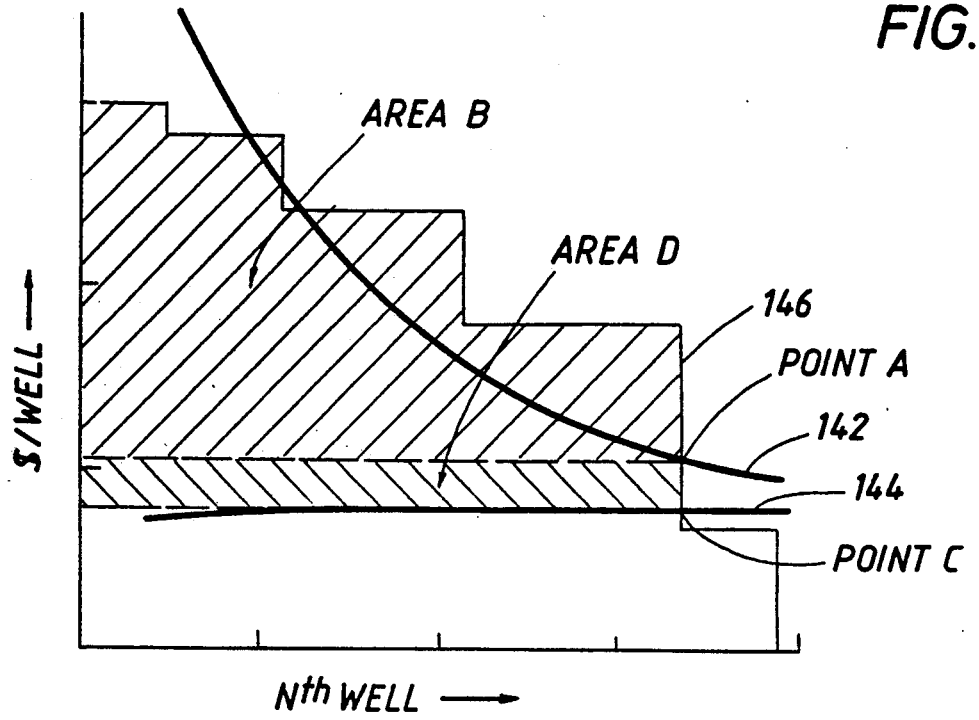
FIG. 14 is a generalized plot of economic curves of cost per well for each additional well for a hypothetical deepwater prospect "A"
Figure 15:
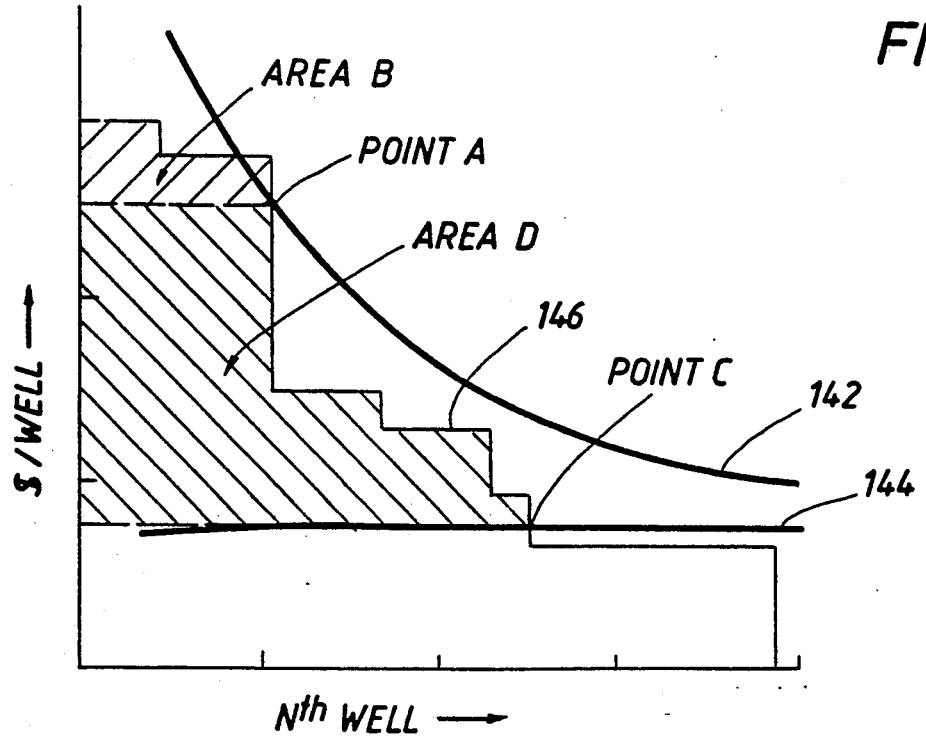
FIG. 15 is a generalized plot of economic curves of cost per well for each additional well for another hypothetical deepwater prospect, prospect "B".

FIGS. 14 and 15 further demonstrate the economic benefits afforded by the practice of the present invention. FIG. 14 is a set of generalized curves for a hypothetical prospect "A". This illustration charts average development dollars per well for a conventional TLP development which includes a dedicated drilling rig (line 142) and a TLWJ development in accordance with the present invention (line 144) versus the number of wells "n" in the development. Also plotted is the present value income for the $n^{th}$ well which is expressed as line 146.

Present value income appears as a stair step function for which incremental contribution by additional wells decreases as the number of wells approaches the reservoir's capacity. Drilling completion costs per well are notionally included in the conventional TLP and the TLWJ development cost curves, but make little impact in the comparison since they are relatively constant regardless of whether a dedicated rig is provided on the TLP in accordance with the prior art or a semisubmersible vessel is used in the practice of the present invention.

Prospect A is a very promising prospect which can support a major, conventional, TLP deployment. The incremental development cost of the conventional TLP deployment, that is line 142, intersects the line defining the present value income per well (line 146), at point A which produces a net present value profit designated by area B. Stated otherwise, the profit is the total income for all developed wells minus the total development cost which is the cost per well at the point of intersection times the number of developed wells.

By contrast, the incremental development cost of a TLWJ in the practice of the present invention intersects the present value income per well line 146 at point C and provides additional income opportunity indicated by area D, for a total present value income per well of B plus D.

While FIG. 14 does illustrate a definite advantage, the practice with less promising prospects such as prospect "B" illustrated in FIG. 15, illustrates more profound benefits available through the practice of the present invention. Again, these generalized economic curves plot development costs and income potential in terms of dollars per well as a function of the next incremental development well. The incremental development costs of a major, dedicated rig TLP remain the same, as do the incremental development costs for a tension leg well jacket deployed in the practice of the present invention. However, the nature of the prospect has markedly affected the available present value income per well. Here, the economic development of a TLP with dedicated drilling facilities is determined by point A, which defines little profitability B. However, the incremental cost of development for additional wells in deployment of a TLWJ in the practice of the present invention, as established by point C, defines a vast incremental benefit as the present value income of area D. Note that this benefit cannot be economically exploited by a major TLP with dedicated drilling facilities. Thus, for the same prospect, the conventional technology provides a present value income B while the present invention provides a present value income of B plus D which, for marginal prospects, can be many times that otherwise available. This also demonstrates that the practice of the present invention can render economical the development of prospects which cannot be economically developed by the prior art.

Other benefits of using multiple, dispersed, minimal compliant platforms include reducing the risk of accident by separating drilling and production operations, as well as reducing the potential magnitude of an accident. Further, it is expected that using minimal compliant platforms in the practice of the present invention will significantly expand the number of suitable fabrications yards that are available and reduce cost as a result of increased competition for the construction contracts.

A number of variations have been disclosed for providing surface accessible completions on compliant platforms which are drilled or completed using temporary facilities of an offshore vessel which then transfers production risers to the compliant platform. However, other modifications, changes and substitutions are intended in the foregoing disclosure. Further, in some instances, some features of the present invention will be employed without a corresponding use of other features described in these preferred embodiments. Accordingly, it is appropriate that the appended claims be construed broadly and in a manner consistent with the spirit and scope of the invention herein.

What is claimed is:

1. A method for establishing hydrocarbon production from an offshore reservoir, comprising:

a) installing a compliant platform at a selected site;

b) restraining an offshore drilling vessel with respect to the compliant platform and positioning the offshore drilling vessel over a selected well site at an ocean floor;

c) conducting drilling operations from the offshore drilling vessel through a drilling riser connected to a well at the selected well site;

d) transferring a production riser which extends from the well near the ocean floor to the offshore drilling vessel from the offshore drilling vessel to the compliant platform;

e) securing the production riser to the compliant platform; and f) establishing communication between the reservoir and a facility on the compliant platform.

2. A method for establishing hydrocarbon production from a deepwater offshore reservoir, comprising:

a) installing a compliant platform at a selected site;

b) restraining an offshore drilling vessel with respect to the compliant platform and positioning the offshore drilling vessel over a selected well site;

c) conducting drilling operations from the offshore drilling vessel through a substantially vertical drilling riser in communication with a well at the selected well site;

d) transferring from the offshore drilling vessel to the compliant platform an assembled production riser which extends from the well adjacent an ocean floor to above an ocean surface;

e) securing the production riser to the compliant platform;

f) establishing communication between the reservoir and a facility on the compliant platform; and g) repositioning the offshore drilling vessel over another selected well site and repeating steps (c) through (f) for each additional selected well site.

3. A method for establishing hydrocarbon production in accordance with claim 2 wherein restraining the offshore drilling vessel with respect to the compliant platform comprises docking a semisubmersible vessel to the compliant platform and positioning the offshore drilling vessel over a selected well site comprises driving the compliant platform out of substantial vertical alignment with a well pattern with the semisubmersible vessel and substantially vertically aligning a drilling derrick of the semisubmersible vessel over the selected well site within the well pattern and securing this position for drilling operations.

4. A method for establishing hydrocarbon production in accordance with claim 3 wherein driving the compliant platform out of substantially vertical alignment with the well pattern with the semisubmersible vessel comprises adjusting the catenary mooring lines which define the position of the semisubmersible vessel.

5. A method for establishing hydrocarbon production in accordance with claim 3 wherein driving the compliant platform out of substantially vertical alignment with the well pattern with the semisubmersible vessel comprises utilizing a dynamic positioning system including a set of thrusters.

6. A method for establishing hydrocarbon production in accordance with claim 3 wherein establishing communication between the reservoir and the facility on the compliant platform comprises:

completing the well from the semisubmersible vessel through the production riser and installing a surface tree thereon before transfer to the compliant platform; and connecting a surface tree provided by the production riser to the facilities through a flexible flowline.

7. A method of establishing hydrocarbon production in accordance with claim 6 wherein transferring the production riser from the offshore drilling vessel to the compliant platform further comprises attaching a buoyancy device to the production riser below the surface tree.

8. A method of establishing hydrocarbon production in accordance with claim 7 wherein transferring the production riser further comprises using a plurality of guylines connected between the production riser and the semisubmersible vessel and the compliant platform to draw the production riser adjacent the compliant platform.

9. A method of establishing hydrocarbon production in accordance with claim 7 wherein transferring the production riser further comprises using the self-righting moment of the buoyancy device to hold the production riser substantially in place while the compliant platform docked to the semisubmersible vessel is brought toward the production riser.

10. A method for establishing hydrocarbon production in accordance with claim 7 wherein installing a tension leg platform comprises installing a tension leg well jacket ("TLWJ") having an outboard, above water, well bay.

11. A method for establishing hydrocarbon production in accordance with claim 3 wherein installing a compliant platform at a selected site comprises installing a tension leg platform having a well bay accessible for laterally receiving production risers.

12. A method for establishing hydrocarbon production in accordance with claim 3 wherein installing a compliant platform at a selected site comprises installing a compliant tower bearing an outboard, above water, well bay.

13. A method for establishing hydrocarbon production in accordance with claim 3 wherein installing a compliant platform at a selected site comprises installing a floating production system ("FPS") having a well bay accessible for laterally receiving production risers.

14. A method for establishing hydrocarbon production in accordance with claim 2 wherein restraining the offshore drilling vessel with respect to the compliant platform comprises docking a semisubmersible vessel to a floating production system ("FPS") and positioning the offshore drilling vessel over the selected well site comprises pulling the FPS out of substantially vertical alignment with a well pattern and substantially vertically aligning a drilling derrick of the semisubmersible vessel over the selected well site by drawing the docked semisubmersible vessel with adjustments in a set of catenary mooring lines anchoring the FPS.

15. A method for establishing hydrocarbon production in accordance with claim 2 wherein positioning the offshore drilling vessel over a selected well site comprises extending the drilling derrick of the offshore drilling vessel substantially over the compliant platform to align the drilling riser adjacent the compliant platform at the approximate position the production riser will ultimately be secured thereto.

16. A method for establishing hydrocarbon production in accordance with claim 15 wherein extending the drilling derrick of the offshore drilling vessel substantially over the compliant platform further comprises placing a central well bay semisubmersible vessel over a monopod configuration compliant platform.

17. A method for establishing hydrocarbon production in accordance with claim 16 wherein restraining the offshore drilling vessel with respect to the compliant platform comprises securing the monopod with a plurality of guylines extending from the semisubmersible.

18. A method for establishing hydrocarbon production in accordance with claim 15 wherein extending the drilling derrick of the offshore drilling vessel substantially over the platform comprises extending a cantilevered deck supporting an end bay drilling derrick of a semisubmersible vessel over the well bay of the compliant platform.

19. A method for establishing hydrocarbon production in accordance with claim 15 wherein establishing communication between the reservoir and the facility on the compliant platform comprises:

completing the well through the production riser from the semisubmersible vessel after the production riser has been transferred and secured to the comliant platform; and installing a surface tree on the production riser and connecting the surface tree to the facilities through a flexible flowline.

20. A method for establishing hydrocarbon production from a deepwater offshore reservoir, comprising:

a) installing a compliant platform at a selected location in substantially vertical alignment with a well pattern;

b) docking a semisubmersible vessel to the compliant platform and driving the joined semisubmersible vessel and compliant platform such that the compliant platform is edged out of alignment with the well pattern and the semisubmersible vessel is brought into substantially vertical alignment over a selected well site within the well pattern;

c) conducting drilling operations for a well at the selected well site from the semisubmersible vessel through a substantially vertical drilling riser;

d) replacing the drilling riser with a production riser which extends from the well at an ocean floor to above an ocean surface using the semisubmersible vessel;

e) completing the well through the production riser using the semisubmersible vessel;

f) transferring the completed production riser from the semisubmersible vessel to the compliant platform;

g) securing the production riser to the compliant platform through a dynamic tensioning device;

h) connecting a surface tree of the completed production riser to a facility on the compliant platform through a flexible flowline; and i) positioning the semisubmersible vessel over another selected well site and repeating steps (c) through (h) for additional selected well sites.

21. A method for establishing hydrocarbon production from a deepwater offshore reservoir, comprising:

a) installing a compliant platform having a laterally accessible well bay;

b) positioning a drilling derrick of a semisubmersible vessel substantially over the well bay of the compliant platform and restraining the movement of the compliant platform with respect to the semisubmersible vessel;

c) conducting drilling operations for a well at an ocean floor from the semisubmersible vessel through a substantially vertical drilling riser supported by the semisubmersible vessel adjacent the well bay of the compliant tower;

d) replacing the drilling riser with a production riser which extends from the well at the ocean floor to the semisubmersible vessel;

e) transferring the production riser from the semisubmersible vessel to the well bay of the compliant platform;

f) securing the production riser to the compliant platform through a dynamic tensioning device;

g) completing the well through the production riser using the drilling derrick of the semisubmersible vessel;

h) connecting a surface tree of the completed production riser to a facility on the compliant platform through a flexible flowline;

i) positioning the semisubmersible vessel over another selected well site and repeating steps (b) through (h) for additional selected well sites.

22. A method for establishing hydrocarbon production from an offshore reservoir, comprising:

a) installing a compliant platform at a selected site;

b) docking an offshore drilling vessel to the compliant platform and positioning the offshore drilling vessel over a selected well site on the ocean floor;

c) conducting drilling operations from the offshore drilling vessel through a substantially vertical riser which extends from a well at the selected well site to the offshore drilling vessel;

d) transferring the riser from the offshore drilling vessel to the compliant platform;

e) securing the riser to the compliant platform through a dynamic tensioning device;

f) establishing communication between a surface completion of the riser and facilities on the compliant platform; and g) relocating the offshore vessel over another selected well site and repeating steps (c) through (f) for additional selected well sites.

23. A method for establishing hydrocarbon production in accordance with claim 22 wherein installing a deepwater compliant platform comprises installing a tension leg platform (TLP) having an outboard, above water, well bay.

24. A method for establishing hydrocarbon production in accordance with claim 23 wherein installing a TLP comprises installing a monopod having a plurality of outboard, above water, peripherally receiving riser tensioners.

25. A method for establishing hydrocarbon production in accordance with claim 22 wherein installing a deepwater compliant platform comprises installing a floating production system bearing an outboard, above water, well bay.

26. A method for establishing hydrocarbon production in accordance with claim 22 wherein installing a deepwater compliant platform comprises installing a compliant tower bearing an outboard, above water, well bay.

27. A method for establishing hydrocarbon production in accordance with claim 22 wherein docking the offshore drilling vessel to the compliant platform over a selected well site further comprises driving the compliant platform out of vertical alignment with the well pattern and vertically aligning a drilling derrick of the offshore drilling vessel over a selected well site within the well pattern and securing this position for drilling operations.

28. A method for establishing hydrocarbon production in accordance with claim 27 wherein driving the compliant platform out of vertical alignment with the well pattern and vertically aligning the drilling derrick of the offshore drilling vessel over a selected well site within the well pattern comprises adjusting a lateral mooring system which controls the position of the docked, combined offshore drilling vessel and compliant platform.

29. A method for establishing hydrocarbon production in accordance with claim 27 wherein driving the compliant platform out of vertical alignment with the well pattern and vertically aligning the drilling derrick of the offshore drilling vessel over a selected well site within the well pattern comprises dynamically positioning the offshore drilling vessel with thrusters.

30. A method for establishing hydrocarbon production in accordance with claim 22 wherein docking the offshore drilling vessel to the compliant platform further comprises providing a semisubmersible vessel having an inboard drilling derrick and a strut/pontoon configuration which allows above water, lateral passage of a riser from the vessel for transfer to the compliant platform.

31. A method for establishing hydrocarbon production in accordance with claim 30 wherein conducting drilling operations from the offshore drilling vessel further comprises completing the well and installing a surface tree and transferring the riser from the offshore drilling vessel to the compliant platform comprises laterally passing the riser from the offshore drilling vessel to a laterally receiving riser tensioning system on the compliant platform.

32. A method for establishing hydrocarbon production in accordance with claim 31 wherein transferring the riser from the offshore drilling vessel further comprises connecting a buoyancy device to the riser below the surface tree.

33. A method for establishing hydrocarbon production in accordance with claim 32 wherein securing the riser to the compliant platform further comprises connecting the riser to an above water dynamic tensioning device and removing the buoyancy device from the riser.

34. A method for establishing hydrocarbon production in accordance with claim 32 wherein securing the riser to the compliant platform through a dynamic tensioning device includes maintaining the buoyancy device on the riser in support of tensioning the riser.

35. A method for developing deepwater hydrocarbon reserves comprising:

a) providing production facilities on a compliant platform positioned to serve a plurality of well sites arranged substantially vertically therebeneath on the ocean floor;

b) providing non-dedicated drilling operations on an offshore drilling vessel;

c) docking the offshore drilling vessel to the compliant platform;

d) displacing the compliant platform with the offshore drilling vessel as necessary to place a derrick of the offshore drilling vessel in substantially vertical alignment with a selected well site;

e) drilling a well at the selected well site with the offshore drilling vessel through a substantially vertical drilling riser;

f) completing the well through a production riser and installing a surface tree on the top of the production riser;

g) laterally transferring the production riser, which extends from the well at the ocean floor to above an ocean surface, from the offshore drilling vessel to a laterally receiving riser tensioning system on the platform;

h) establishing communication between the surface tree of the production riser and facilities on the compliant platform;

i) shifting the offshore drilling vessel to a position in which the offshore drilling vessel is substantially in vertical alignment with another well site; and j) repeating steps (c) through (i) as set forth above until each of the desired wells is drilled and placed in communication with the facilities on the compliant platform.

36. A method for establishing production of hydrocarbons from offshore reservoirs, said method comprising:

installing a tension leg well jacket at a selected site;

drilling and completing a well at a selected position within a pattern about the base of the tension leg well jacket using a semisubmersible vessel temporarily docked to the tension leg well jacket;

laterally transferring from the semisubmersible vessel to riser tensioners supported by the tension leg well jacket, a surface accessible production riser which extends from the well adjacent an ocean floor to above an ocean surface; and connecting a surface tree at the top of the production riser to a production facility carried on the tension leg well jacket.

37. A method for establishing hydrocarbon production in accordance with claim 36, further comprising shifting the semisubmersible vessel over another selected well site within the pattern about the base of the tension leg well jacket and repeating the drilling, completion, transferring and connection steps set forth above until the desired wells have been drilled and completed with the facilities on the semisubmersible vessel and are secured to the TLWJ for production operations.

38. A method for establishing production of hydrocarbons in accordance with claim 37 wherein the well is completed and provided with a surface tree before laterally transferring the production riser.

39. A method for establishing production of hydrocarbons in accordance with claim 37 wherein the production riser is laterally transferred from the semisubmersible vessel to the riser tensioner supported by the tension leg well jacket before the well is completed using the semisubmersible vessel.

40. A method for establishing production of hydrocarbons from offshore reservoirs, said method comprising:

installing a tension leg well jacket at a selected site;

drilling and completing a well at a selected position within a pattern about the base of the tension leg well jacket using a semisubmersible vessel temporarily docked to the tension leg well jacket;

laterally transferring from the semisubmersible vessel to riser tensioners supported by the tension leg well jacket a surface accessible, completed production riser in communication with the well extending to the well at a lower end and projecting above an ocean surface at an upper end;

connecting a surface tree at the top of the production riser to a production facility carried on the tension leg well jacket; and shifting the semisubmersible vessel over another selected well site within the pattern about the base of the TLP and repeating the drilling, completion, transferring and connection steps set forth above until the desired wells have been drilled and completed with the facilities on the semisubmersible vessel and are secured to the tension leg well jacket for production operations.

41. A method for establishing production of hydrocarbons in accordance with claim 40 wherein laterally transferring the surface accessible completed production riser comprises:

attaching a buoyancy device to the production riser below the surface tree; and drawing the production riser adjacent the tension leg well jacket with guylines connected between the production riser and the semisubmersible vessel and the tension leg well jacket.

42. A method for establishing production of hydrocarbons in accordance with claim 40 wherein laterally transferring the surface accessible completed production riser comprises:

supporting the production riser with a buoyancy device attached below the surface tree;

using the self-righting moment of the buoyancy device to hold the production riser substantially in place while the tension leg well jacket docked to the semisubmersible vessel is maneuvered toward the production riser; and drawing the completed production riser into place in the TLWJ well bay with guylines connected between the production riser, and the semisubmersible vessel and the tension leg well jacket.

43. A method for establishing production of hydrocarbons in accordance with claim 40 wherein drilling and completing the well further comprises conducting drilling operations through a drilling riser and replacing the drilling riser with a production riser for completion operations.

44. A method for establishing production of hydrocarbons in accordance with claim 40 wherein drilling operations are conducted through a riser serving as a drilling riser and the completion operations are conducted through said riser serving as a production riser.

45. A method for establishing hydrocarbon production in accordance with claim 1 wherein restraining the offshore drilling vessel with respect to the compliant platform comprises docking a semisubmersible vessel to the compliant platform and positioning the offshore drilling vessel over a selected well site comprises driving the compliant platform out of substantial vertical alignment with a well pattern with the semisubmersible vessel and substantially vertically aligning a drilling derrick of the semisubmersible vessel over the selected well site within the well pattern and securing this position for drilling operations.

46. A method for establishing hydrocarbon production in accordance with claim 45 wherein driving the compliant platform out of substantially vertical alignment with the well pattern with the semisubmersible vessel comprises adjusting the catenary mooring lines which define the position of the semisubmersible vessel.

47. A method for establishing hydrocarbon production in accordance with claim 45 wherein driving the compliant platform out of substantially vertical alignment with the well pattern with the semisubmersible vessel comprises utilizing a dynamic positioning system including a set of thrusters.

48. A method for establishing hydrocarbon production in accordance with claim 45 wherein establishing communication between the reservoir and the facility on the compliant platform comprises:

completing the well from the semisubmersible vessel through the production riser and installing a surface tree thereon before transfer to the compliant platform; and connecting a surface tree provided at the top of the production riser to the facilities through a flexible flowline.

49. A method of establishing hydrocarbon production in accordance with claim 48 wherein transferring the production riser from the offshore drilling vessel to the compliant platform further comprises attaching a buoyancy device to the production riser below the surface tree.

50. A method of establishing hydrocarbon production in accordance with claim 49 wherein transferring the production riser further comprises using a plurality of guylines connected between the production riser and the semisubmersible vessel and the compliant platform to draw the production riser adjacent the compliant platform.

51. A method of establishing hydrocarbon production in accordance with claim 49 wherein transferring the production riser further comprises using the self-righting moment of the buoyancy device to hold the production riser substantially in place while the compliant platform docked to the semisubmersible vessel is brought toward the production riser.

52. A method for establishing hydrocarbon production in accordance with claim 49 wherein installing a tension leg platform comprises installing a tension leg well jacket ("TLWJ") having an outboard, above water, well bay.

53. A method for establishing hydrocarbon production in accordance with claim 45 wherein installing a compliant platform at a selected site comprises installing a tension leg platform having a well bay accessible for laterally receiving production risers.

54. A method for establishing hydrocarbon production in accordance with claim 45 wherein installing a compliant platform at a selected site comprises installing a compliant tower bearing an outboard, above water, well bay.

55. A method for establishing hydrocarbon production in accordance with claim 45 wherein installing a compliant platform at a selected site comprises installing a floating production system ("FPS") having a well bay accessible for laterally receiving production risers.

56. A method for establishing hydrocarbon production in accordance with claim 1 wherein restraining the offshore drilling vessel with respect to the compliant platform comprises docking a semisubmersible vessel to a floating production system and positioning the offshore drilling vessel over the selected well site comprises pulling the floating production system out of substantially vertical alignment with a well pattern and substantially vertically aligning a drilling derrick of the semisubmersible vessel over the selected well site by drawing the docked semisubmersible vessel with adjustments in a set of catenary mooring lines anchoring the floating production system.

57. A method for establishing hydrocarbon production in accordance with claim 1 wherein positioning the offshore drilling vessel over a selected well site comprises extending the drilling derrick of the offshore drilling vessel substantially over the compliant platform to align the drilling riser adjacent the compliant platform at the approximate position the production riser will ultimately be secured thereto.

58. A method for establishing hydrocarbon production in accordance with claim 57 wherein extending the drilling derrick of the offshore drilling vessel substantially over the compliant platform further comprises placing a central well bay semisubmersible vessel over a monopod configuration compliant platform.

59. A method for establishing hydrocarbon production in accordance with claim 58 wherein restraining the offshore drilling vessel with respect to the compliant platform comprises securing the monopod with a plurality of guylines extending from the semisubmersible.

60. A method for establishing hydrocarbon production in accordance with claim 57 wherein extending the drilling derrick of the offshore drilling vessel substantially over the platform comprises extending a cantilevered deck supporting an end bay drilling derrick of a semisubmerible vessel over the well bay of the compliant platform.

61. A method for establishing hydrocarbon production in accordance with claim 57 wherein establishing communication between the reservoir and the facility on the compliant platform comprises:

completing the well through the production riser from the semisubmersible vessel after the production riser has been transferred and secured to the compliant platform; and installing a surface tree on the production riser and connecting the surface tree to the facilities through a flexible flowline.

62. A method for establishing hydrocarbon production from an offshore reservoir, comprising:

a) installing a compliant platform at a selected offshore location and anchoring the compliant platform to the ocean floor;

b) an offshore drilling vessel with respect to the compliant platform and positioning at least a portion of the offshore drilling vessel over a selected well site;

c) conducting well drilling operations from the offshore drilling vessel through a substantially vertical drilling riser to drill a well into the ocean floor to the offshore reservoir;

d) removing the drilling riser and installing an assembled production riser that extends substantially vertically from the top of the well to above the ocean surface;

e) transferring the support for the assembled production riser from the offshore drilling vessel to the compliant platform;

f) securing the upper end of the production riser under tension to the compliant platform; and g) establishing communication between the reservoir and a facility on the compliant platform.

* * * * *